US007924251B2

(12) United States Patent
Miyasaka et al.

(10) Patent No.: US 7,924,251 B2
(45) Date of Patent: Apr. 12, 2011

(54) IMAGE PROCESSING METHOD, DISPLAY DEVICE AND DRIVING METHOD THEREOF

(75) Inventors: Daigo Miyasaka, Tokyo (JP); Masao Imai, Tokyo (JP)

(73) Assignee: NEC Corporation, Tokyo (JP)

( * ) Notice: Subject to any disclaimer, the term of this patent is extended or adjusted under 35 U.S.C. 154(b) by 1335 days.

(21) Appl. No.: 11/053,422

(22) Filed: Feb. 9, 2005

(65) Prior Publication Data

US 2005/0253785 A1 Nov. 17, 2005

(51) Int. Cl.
*G09G 3/36* (2006.01)

(52) U.S. Cl. ..... 345/87; 345/690

(58) Field of Classification Search ..... 345/87–104, 345/690–693, 204
See application file for complete search history.

(56) References Cited

U.S. PATENT DOCUMENTS

| | | | | |
|---|---|---|---|---|
| 6,396,508 | B1 * | 5/2002 | Noecker | 345/693 |
| 6,791,527 | B2 * | 9/2004 | Yoshinaga et al. | 345/102 |
| 7,233,342 | B1 * | 6/2007 | Yamazaki et al. | 345/692 |
| 7,400,321 | B2 * | 7/2008 | Aiba et al. | 345/204 |
| 2001/0048420 | A1 * | 12/2001 | Yamamoto et al. | 345/89 |
| 2002/0003522 | A1 * | 1/2002 | Baba et al. | 345/89 |
| 2002/0057241 | A1 * | 5/2002 | Oda et al. | 345/87 |
| 2004/0041768 | A1 * | 3/2004 | Chen et al. | 345/90 |

FOREIGN PATENT DOCUMENTS

| | | |
|---|---|---|
| JP | 2000-122596 | 4/2000 |
| JP | 2000-275604 | 10/2000 |
| JP | 2002-23707 | 1/2002 |
| JP | 2002-148712 | 5/2002 |

* cited by examiner

*Primary Examiner* — Amr Awad
*Assistant Examiner* — Michael Pervan
(74) *Attorney, Agent, or Firm* — Young & Thompson

(57) ABSTRACT

The present invention provides an image processing method of a hold type display device, a driving method of the display device and a display device driven by the method, for improving the moving picture quality without lowering the luminance and the contrast. In the image processing method for dividing one frame into sub frames, luminance components of a certain sub frame are distributed to other sub frames, so as to generate sub frame with luminance components higher than the average in the one frame and sub frame with luminance components lower than the average in the one frame, as a result of which the amount of luminance during one frame period is kept constant before and after the distribution of luminance components.

29 Claims, 28 Drawing Sheets

FIG. 5

421

| MAXIMUM GRADATION | COUNTER VALUE | | | |
|---|---|---|---|---|
| | 1 | 2 | ... | n |
| 0 ... $int(255 \times (1/\eta)^{\frac{1}{2.2}})$ | $n^{\frac{1}{2.2}}$ | 0 ... | ... | 0 |
| $int(255 \times (1/\eta)^{\frac{1}{2.2}})+1$ ... X1 ... $int(255 \times (2/\eta)^{\frac{1}{2.2}})$ | 255/X1 | $(\eta-(255/X1)^{\frac{1}{2.2}})^{\frac{1}{2.2}}$ ... | ... | 0 |
| ... | ... | ... | ... | ... |
| $int(255 \times ((\eta-1)/\eta)^{\frac{1}{2.2}})+1$ ... Xn−1 ... 255 | 255/Xn−1 | 255/Xn−1 ... | ... | $(\eta-(\eta-1) \times (255/X\eta-1)^{\frac{1}{2.2}})^{\frac{1}{2.2}}$ |

FIG. 6

| | COUNTER VALUE | | |
|---|---|---|---|
| MAXIMUM GRADATION | 1 | 2 | 3 |
| 0 | 1.647 | 0 | 0 |
| • | | | |
| • | 1.647 | 0 | 0 |
| • | | | |
| 154 | 1.647 | 0 | 0 |
| 155 | 1.645 | 0.123 | 0 |
| • | | | |
| • | | | |
| • | | | |
| X1 | 255/X1 | $((3-(255/X1)^{2.2})^{\frac{1}{2.2}}$ | 0 |
| • | | | |
| • | | | |
| • | | | |
| 212 | 1.202 | 1.202 | 0 |
| 213 | 1.197 | 1.197 | 0.197 |
| • | | | |
| • | | | |
| • | | | |
| X2 | 255/X2 | 255/X2 | $(3-2\times(255/X2)^{2.2})^{\frac{1}{2.2}}$ |
| • | | | |
| • | | | |
| • | | | |
| 255 | 1 | 1 | 1 |

421

FIG. 10

| | COUNTER VALUE | | |
|---|---|---|---|
| MAXIMUM GRADATION | 1 | 2 | 3 |
| 0 | 0 | 0 | 0 |
| • | 1.647×X1 | 0 | 0 |
| • | | | |
| 154 | 254 | 0 | 0 |
| 155 | 255 | 19 | 0 |
| • | | | |
| • | | | |
| • | | | |
| X1 | 255 | $255\times(3\times(X1/255)^{2.2}-1)^{\frac{1}{2.2}}$ | 0 |
| • | | | |
| • | | | |
| • | | | |
| 212 | 255 | 255 | 0 |
| 213 | 255 | 255 | 42 |
| • | | | |
| • | | | |
| • | | | |
| X2 | 255 | 255 | $255\times(3\times(X1/255)^{2.2}-2)^{\frac{1}{2.2}}$ |
| • | | | |
| • | | | |
| 255 | 255 | 255 | 255 |

451

F I G. 12

| | COUNTER VALUE | | |
|---|---|---|---|
| MAXIMUM GRADATION | 1 | 2 | 3 |
| 0-154 | 1.647 | 0 | 0 |
| 155-212 | 1.202 | 1.202 | 0 |
| 213-255 | 1 | 1 | 1 |

421A

F I G. 19

| | COUNTER VALUE | |
|---|---|---|
| MAXIMUM GRADATION | 1 | 2 |
| 0 | 1.202 | 0 |
| • | | |
| • | 1.202 | 0 |
| • | | |
| 212 | 1.202 | 0 |
| 213 | 1.197 | 0.197 |
| • | | |
| • | | |
| • | | |
| X1 | 255/X1 | $(3-2\times(255/X1)^{\frac{1}{2.2}})^{\frac{1}{2.2}}$ |
| • | | |
| • | | |
| • | | |
| 255 | 1 | 1 |

423

F I G. 28

| INPUT GRADATION | COUNTER VALUE 1 | 2 | 3 |
|---|---|---|---|
| 0 | 0 | 0 | 0 |
| • | | | |
| • | | | |
| • | | | |
| X1 | 0 | 1.647×X1 | 0 |
| • | | | |
| • | | | |
| • | | | |
| 154 | 0 | 254 | 0 |
| 155 | 19 | 255 | 0 |
| • | | | |
| • | | | |
| • | | | |
| X1 | $255\times(3\times(X1/255)^{\frac{1}{2.2}}-1)^{\frac{1}{2.2}}$ | 255 | 0 |
| • | | | |
| • | | | |
| • | | | |
| 212 | 255 | 255 | 0 |
| 213 | 255 | 255 | 42 |
| • | | | |
| • | | | |
| • | | | |
| X2 | 255 | 255 | $255\times(3\times(X1/255)^{\frac{1}{2.2}}-2)^{\frac{1}{2.2}}$ |
| • | | | |
| • | | | |
| • | | | |
| 255 | 255 | 255 | 255 |

461

IMAGE PROCESSING METHOD, DISPLAY DEVICE AND DRIVING METHOD THEREOF

BACKGROUND OF THE INVENTION

1. Field of the Invention

The present invention relates to an image processing method of a hold type display device and a driving method therefor and a display device using the driving method, and more particularly to an image processing method and a driving method of a display device and a display device using the driving method, for improving the image quality of a moving picture (moving picture quality).

2. Description of the Related Art

In recent years, the size of a display screen, the display precision and the purity of unmixed color have been increased in an active matrix type liquid crystal display device, so that a still image with sufficiently high image quality can be displayed. On the other hand, although in displaying a moving picture, the image quality has been improved by increasing the response speed of liquid crystals, an image quality equivalent to CRT (Cathode Ray Tube) has not yet been obtained.

When a moving picture display is performed by a hold type display device including a liquid crystal display device, the contour of a moving object is visually recognized as blurred for the observer who watches the display object moving on the screen, so that the moving picture quality is recognized to be lowered (hereafter, a phenomenon (blurring of moving picture) in which the contour of a display object is visually recognized as blurred due to the movement of the display object on the screen is noted as "edge blurring").

Causes of such deterioration of the moving picture quality in the hold type display device are explained in detail in Ishiguro, Kurita, The Institute of Electronics, Information and Communication Engineers technical research report, EID 96-4 (1996) (hereinafter referred to as Non Patent Document 1). It is described in Non Patent Document 1 that the deterioration of the moving picture quality in a liquid crystal display device is, in principle, caused by the 0 order holding (continuously displaying the same gradation within one frame period) in an active element, such as TFT (Thin Film Transistor).

This indicates that the deterioration of the moving picture quality cannot be prevented only by increasing the response speed of liquid crystal in the liquid crystal display device. That is, the deterioration of the moving picture quality is caused by the 0 order holding of a display element, and cannot be avoided by the conventional driving method.

The deterioration of the moving picture quality can be improved by increasing the rewriting speed (frame frequency) of a picture, but in this method, originally non-existent frame pictures (pictures displayed between the original frame pictures) need to be interpolated by image processing, as a result of which it becomes difficult to improve the deterioration of the moving picture quality by this method. When the frame frequency is set high, the amount of data at the time of transmitting a video signal is increased, which makes it impossible to apply the method to existing broadcast facilities in which the capacity of transmission lines for video signals is not ensured sufficiently.

In order to solve the above problems, several methods have been proposed, in which a liquid crystal having a high speed response characteristic is used to perform black resetting within a frame (displaying black in the pixel without regard to its original gradation value during a predetermined period within one frame), thereby realizing a pseudo impulse type display for improving the moving picture quality.

Methods for performing the black resetting include a (black reset driving) method of writing in a liquid crystal a reset voltage corresponding to the black output (the first black resetting method), a method of flashing the backlight synchronously with the frame period (the second black resetting method) and a method of using an optical shutter moving in the same direction as the scanning direction of driving (the third black resetting method). Conventional techniques relating to the first black resetting include a "display device" disclosed in Japanese Patent Application Publication No. 2000-122596 (page 6 to 7, FIG. 7) (hereinafter referred to as Patent Document 1) and a "display device" disclosed in Japanese Patent Application Publication No. 2002-23707 (page 4 to 5, FIG. 6) (hereinafter referred to as Patent Document 2). Conventional techniques relating to the second black resetting method include a "liquid crystal display device" disclosed in Japanese Patent Application Publication No. 2000-275604 (hereinafter referred to as Patent Document 3). Further, conventional techniques relating to the third black resetting method include a "projection type liquid crystal display device" disclosed in Japanese Patent Application Publication No. 2002-148712 (hereinafter referred to as Patent Document 4).

The invention disclosed in Patent Document 1 provides a display surface having a plurality of pixel lines, where the display surface is configured such that during a period of writing an image into at least one of the plurality of pixel lines, black color is written in other pixel lines to enable the black resetting to be performed, thereby improving the moving picture quality.

The invention disclosed in Patent Document 2 provides a hold type display device, in which a frame, serving as a unit time for displaying a picture, is time-divided into a plurality of sub frames, and in which the luminance of a picture inputted to the device itself is decreased at a predetermined rate in accordance with the luminance of a previously inputted picture. The employment of such configuration of the invention disclosed in Patent Document 2 prevents a picture from becoming blurred or obscure in displaying a moving picture, while suppressing the lowering of the luminance of a picture.

The invention disclosed in Patent Document 3 provides a liquid crystal display device in which an illuminator having a plurality of lamps is divided, and after a fixed time period from the time when a response is made by a liquid crystal display section, each of which corresponds to each divided area of the illuminator, lamps of the illuminator in the area corresponding to the responded area are controlled to be turned on by an illumination driver and then after a fixed time period to be turned off. Such configuration decreases the edge blurring due to the 0 order holding, thereby enabling the moving picture quality to be improved.

The invention disclosed in Patent Document 4 provides a configuration in which a mechanical or electric shutter is arranged in the optical path, and opened and closed in sync with one field of the display picture so as to cut off non-stationary parts of the display light. Such configuration decreases the edge blurring due to the 0 order holding, thereby enabling the moving picture quality to be improved.

However, each method for preventing the edge blurring by inserting the above described black resetting, which is capable of suppressing deterioration of the moving picture quality resulting from the 0 order holding, causes another problem in which the displaying luminance and the contrast are lowered by inserting the black resetting.

In particular, the application of the techniques according to the inventions disclosed in the above described Patent Documents 1 and 2 lowers the luminance at the time of displaying white color, which has the maximum luminance.

In the invention disclosed in the above described Patent Document 3, the reduction in the display luminance at the time of displaying a still image is suppressed by making all the light sources of the illuminator into a lighted state, but at the time of displaying a moving picture, the luminance level is lowered compared to the case where the black resetting is not performed, as in the case of the inventions described in the Patent Documents 1 and 2.

The invention disclosed in the above described Patent Document 4 allows the black resetting to be performed only with the entire screen of the display device or with one line as a unit. As a result, at the time of displaying a moving picture, pixels without the need of being black reset are made to be black reset, so that the display luminance is lowered.

In this way, hitherto, it has been impossible to improve the moving picture quality without decreasing the maximum luminance and the contrast.

SUMMARY OF THE INVENTION

The present invention has been made in view of the aforementioned circumstances. An object of the present invention is to provide an image processing method, a method for driving a display device and a display device driven by the method, for improving the moving picture quality in a hold type display device without lowering the maximum luminance and the contrast.

In order to achieve the above object, according to the present invention, there is provided, as a first embodiment, an image processing method in which a video signal for one frame period is time-divided into a plurality of sub frames, and at least a part of luminance components of the video signal of a predetermined sub frame is distributed to the video signal of other sub frames of which luminance components are not saturated.

In the first embodiment, the video signal is the gradation signal indicating the output level of a display element, and gradation values of the video signal of a sub frame are preferably distributed to the video signal of other sub frames. In addition, the integrated luminance for one frame period is preferably not changed before and after the distribution of the luminance components.

SUMMARY OF THE INVENTION

In any image processing method of the above described first embodiment, for any video signal with a plurality of color components forming a color video, at least a part of luminance components of the video signal of a predetermined sub frame are preferably distributed to the video signal of other sub frames of which luminance components are not saturated, at the same ratio as that of a color component with the maximum integrated luminance.

In order to achieve the above object, according to the present invention, there is provided, as a second embodiment, a driving and controlling method of the hold type display device, in which light with a luminance corresponding to an inputted video signal is displayed by a display element for a predetermined period, characterized in that the video signal for one frame period is time-divided into a plurality of sub frames, at last a part of luminance components of the video signal of a predetermined sub frame are distributed to the video signal of other sub frames of which luminance components are not saturated, and in that light with a luminance corresponding to the video signal of each sub frame to which the luminance components are distributed, is displayed by the display element for the sub frame period.

In the above described second embodiment according to the invention, it is preferred that the video signal is the gradation signal indicating the output level of the display element, and that gradation values of the video signal of a predetermined sub frame are distributed to the video signal of the other frames. The integrated luminance in one frame period is also preferably not changed before and after the distribution of the luminance components.

In any driving and controlling method of the hold type display device according to the above described second embodiment, it is preferred that the video signal is a color video signal consisting of a plurality of color components, and that at least a part of luminance component of the video signal of a predetermined sub frame, for each color component, is distributed to the video signal of other sub frames of which luminance components are not saturated, at the same ratio as that of a color component with the maximum integrated luminance.

In order to achieve the above object, according to the present invention, there is provided, as a third embodiment, a display device comprising: image processing means for outputting an inputted video signal as gradation signals after subjecting the inputted video signal to an image processing; and display means for displaying a picture with a luminance in accordance with the gradation signal outputted from the image processing means, the image processing means comprising: means for time-dividing the video signal for one frame period into a plurality of sub frames; means for specifying an order number of each time-divided sub frame, the order number being assigned to each sub frame in one frame; and gradation conversion means for generating gradation signals for each sub frame, so as to distribute at least a part of luminance components of the video signal of a predetermined sub frame to the video signal of other sub frames of which luminance components are not saturated.

In the above described third embodiment according to the present invention, the gradation conversion means preferably distributes at least a part of luminance components of the video signal of a predetermined sub frame to the video signal of other frames of which luminance components are not saturated, by performing the four basic arithmetic operations or referring to a look up table.

In order to achieve the above object, according to the present invention, there is provided, as a fourth embodiment, a display device comprising: gradation voltage generation means for generating gradation voltage signals based on an inputted video signal and for outputting the gradation voltage signals; and display means for displaying a picture with a luminance corresponding to the gradation voltage signals, the display device further comprising: means for time-dividing the video signal of one frame into a plurality of sub frames; and means for specifying an order number of each time-divided sub frame, the order number being assigned to each sub frame in one frame; and means for changing a reference voltage, base on which the gradation voltage generation means generates the gradation voltage signals, so as to distribute at least a part of luminance components of the video signal of a predetermined sub frame to the video signal of other sub frames of which luminance components are not saturated.

In the above described third and fourth embodiments according to the present invention, it is preferred that the video signal is a color video signal consisting of a plurality of color components, and that at least a part of luminance component of the video signal of a predetermined sub frame, for each color component, is distributed to the video signal of other sub frames of which luminance components are not saturated, at the same ratio as that of a color component with the maximum integrated luminance. The integrated luminance of one frame period is also preferably not changed before and after the distribution of luminance components.

In order to achieve the above object, according to the present invention, there is provided, as a fifth embodiment, a display device comprising: image processing means for outputting an inputted video signal as gradation signals after subjecting the inputted video signal to an image processing; and a display means for displaying a picture with a luminance in accordance with the gradation signals outputted from the image processing means, wherein the image processing means performs the image processing method according to the above described first embodiment of the present invention, for the inputted video signal.

In order to achieve the above describe object, according to the invention, there is provided, as a sixth embodiment, a display device wherein a picture is displayed in accordance with a driving method of the hold type display device according to the above described second embodiment of the invention.

According to the present invention, it is possible to provide an image processing method, a method for driving a display device and a display device driven by the method, for improving the moving picture quality in a hold type display device without lowering the maximum luminance and the contrast.

BRIEF DESCRIPTION OF THE DRAWINGS

Preferred embodiments of the invention are described below with reference to the drawings, which are described as follows:

FIG. 5 shows an example of LUT provided for a magnification factor setting section of the liquid crystal display device according to the first embodiment for preferably carrying out the present invention;

FIG. 6 is shows an example of LUT provided for the magnification factor setting section of the liquid crystal display device according to the first embodiment;

FIG. 10 shows an example of LUT provided for a gradation conversion section of the liquid crystal display device according to the second embodiment;

FIG. 12 shows an example of LUT provided for a magnification factor setting section of the liquid crystal display device according to the third embodiment;

FIG. 19 shows an example of LUT provided for a magnification factor setting section of the liquid crystal display device according to the sixth embodiment;

FIG. 28 shows another exemplary configuration of LUT provided for a gradation conversion section of the liquid crystal display device according to the eighth embodiment.

DETAILED DESCRIPTION OF THE PREFERRED EMBODIMENTS

Principle of the Invention

A digital video signal inputted into a hold type display device, such as a liquid crystal display device, is sent at a rate of f frames per one second. The f is referred to as the frame frequency. In a common hold type display device, the frame frequency is the same as the drive frequency (operation frequency of the hold type display device for rewriting a screen display).

However, in the present invention, the drive frequency is set higher than the frame frequency. The principle of the invention is hereinafter explained by an example of the case where the drive frequency is n times the frame frequency. In this case, one frame (frame period) is divided into n sub frames (drive cycles). That is, in order to rewrite a picture at the sub frame period in the present invention, the drive frequency becomes n times the frame frequency (n×f), and the drive period becomes 1/(n×f).

The configuration described in the specification is the same as that of a conventional hold type display device, except that the drive frequency is higher than the frame frequency, unless otherwise specified. That is, the present invention is primarily aiming at the way of assigning gradation to each of the n number of time-divided sub frames.

Figure 1:
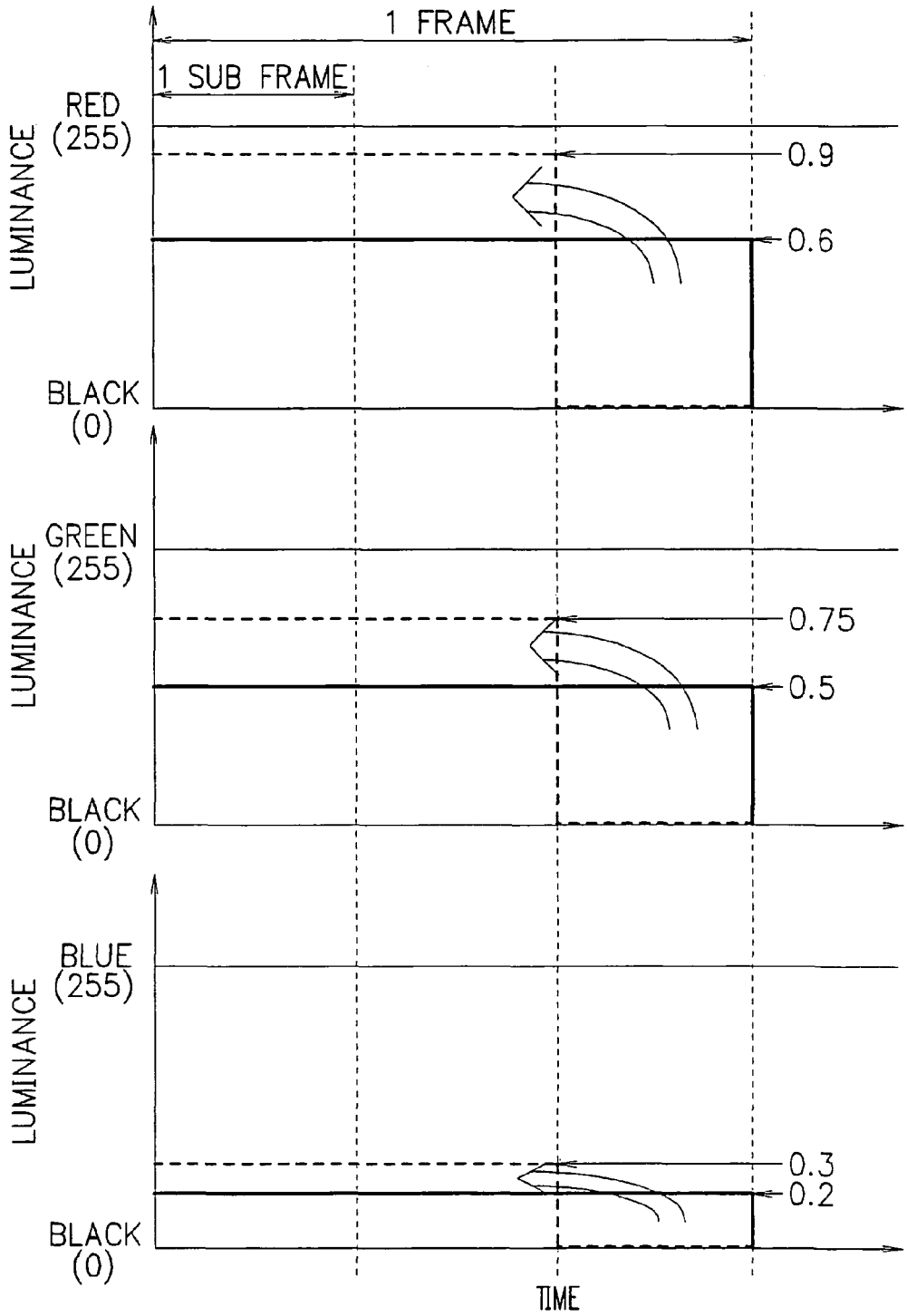
FIG. 1 shows a principle of the present invention.

FIG. 1 shows an example of the way of assigning the gradation to each of sub frames constituting one frame. Here, the case of n=3 is taken as an example. The horizontal axis shows time and the vertical axis shows the luminance of each RGB component. Hereafter, the method of distributing luminance components to each sub frame of one frame is explained with reference to FIG. 1.

In the case where gradations of three sub frames are independently controllable, extremely large number of combinations are present in the gradation expressing method. For example, in the case where the input signal values of a pixel are (R, G, B)=(0.6, 0 5, 0.2) based on a luminance conversion in which the luminance of white is defined as 1, the output values of any of three sub frames may be considered to be set to (0.6, 0.5, 0.2) (FIG. 1: thick lines). In this case, a moving picture displayed on the screen is the same as that of the hold type display device in which the drive frequency is the same as the frame frequency, so that the moving picture quality is not improved.

Alternatively, in the case where each output value of the first and second sub frames is set to (0.6, 0.5, 0.2) and the output value of the third sub frame is set to (0, 0, 0) without regard to the input signal value, which is the so-called "black reset driving", the deterioration of the moving picture quality resulting from the hold type display is reduced. However, since the black display is performed in the third frame, which is originally to be displayed by the luminance corresponding to the input signal value, the luminance of one entire frame is lowered.

A hold type display device according to the present invention is configured such that any one of luminance components of n sub frames is distributed to other frames (in the above described example, the luminance components of the third sub frame are distributed to the first and second sub frames). For example, by setting the sub frame values of the first and second sub frames to (0.9, 0.75, 0.3) and the sub frame value of the third sub frame to (0, 0, 0), the integrated luminance in one entire frame is kept constant and deterioration of the moving picture quality can be reduced, without causing the luminance to be lowered (FIG. 1: thick dotted outlines).

On the other hand, when an input signal value is larger than (n−1)/n, it is not possible to distribute all the luminance components of any sub frame to other sub frames. For example, in the case of n=3, when an input signal value is larger than ⅔, all the luminance components of the third sub frame cannot be distributed to other frames. In this case, the moving picture quality can be improved by distributing the luminance components of any of the sub frames to other sub frames as much as possible.

Since the luminance components of any of the sub frames can not be distributed to other sub frames in white display (since the luminance components of all sub frames are the maximum), distribution of the luminance is not performed.

In a natural picture, which does not contain a large number of pixels with an extremely high luminance (making distribution of luminance components of any of sub frames to other sub frames impossible), the moving picture quality of a moving picture may be improved, even in the case where the moving picture contains such pixels.

Although with an increase in the luminance of the entire screen display, flickers are tend to be conspicuous, the screen display, according to the present invention, is rewritten for each sub frame, which is the same state as the case where the refresh rate is made n-fold, thereby enabling the generation of flickers to be suppressed.

By employing such configuration, the lowering of the maximum luminance can be suppressed and the moving picture quality can be improved.

In the method for assigning the gradation to n sub frames, the number of sub frames on which luminance components are concentrated is made as small as possible, or the source of the luminance components is fixed. That is, the number of the sub frame with the least luminance components is preferably kept to be the same during the processing.

Specific methods for assigning the gradation include a method for multiplying an input video signal by a magnification obtained based on each sub frame number, and a method for performing a gradation conversion using a look-up table. In the case of a liquid crystal display device, the method can also be realized by a configuration where a reference gradation voltage of a DA converter for converting a digital gradation signal into an analog voltage to be written in the liquid crystal, is made to be changed. The specific methods are not limited to the above methods, and other techniques, which enables the results based on the above described assigning methods to be obtained, may also be applied.

The distribution quantity from a sub frame of the distribution source to a sub frame of the distribution destination need not be uniform. For example, in the case of n=3, even in the case where the quantity distributed to the first sub frame is increased more than the quantity distributed to the second sub frame, the moving picture quality can be improved. Also, any sub frame may be the distribution source for distributing luminance components. That is, the distribution is not limited to the case from the third sub frame to the first and second sub frames, but the distribution may be performed from the first sub frame to the second and third sub frames, and from the second sub frame to the first and the third sub frames. However, all the serial moving pictures need to be processed with a sub frame of the same number fixed as the distribution source.

In the following, the preferred embodiments according to the present invention based on the above described principle are explained.

First Embodiment

Configuration of the Invention

Figure 2:
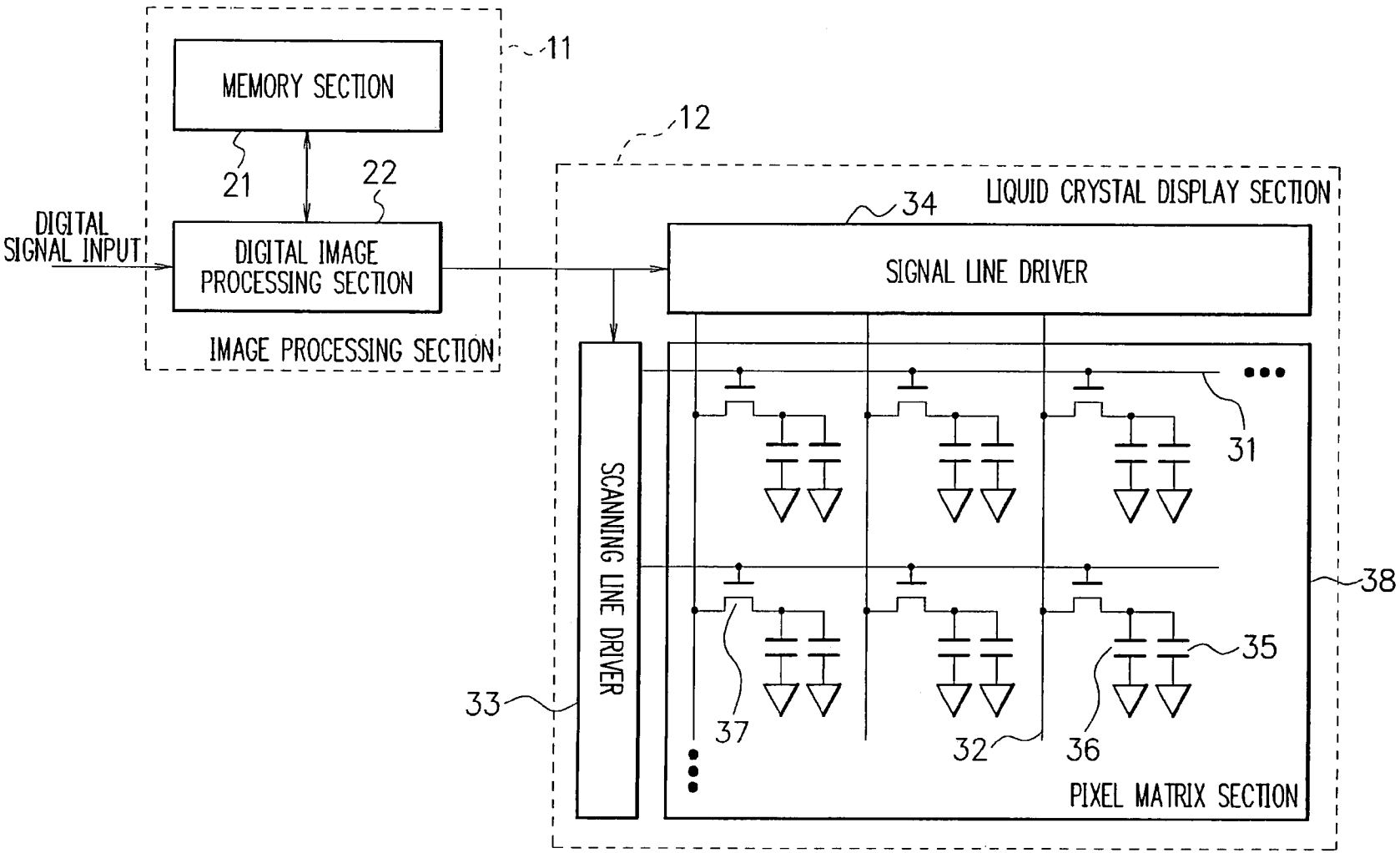
FIG. 2 shows a configuration of a liquid crystal display device according to a first embodiment for preferably carrying out the present invention.

A first embodiment for preferably carrying out the invention is described. FIG. 2 shows a configuration of a liquid crystal display device according to the present embodiment. The liquid crystal display device comprises an image processing section 11 and a liquid crystal display section 12. The image processing section 11 comprises a memory section 21 for storing input picture signals and a digital image processing section 22 for performing arithmetic operation on the input picture signals.

The liquid crystal display section 12 comprises a scanning line driver 33, a signal line driver 34, and a pixel matrix section 38. The pixel matrix section 38 comprises a plurality of scanning lines 31, a plurality of signal lines 32, a plurality of pixels 35, an auxiliary capacitors 36, and thin-film transistors (TFT) 37. A plurality of scanning lines 31 and a plurality of signal lines 32 intersect each other. The pixel 35 is provided for each part where the scanning line 31 and the signal line 32 intersect, via the TFT 37. The auxiliary capacitor 36 is connected in parallel with each pixel 35, so as to suppresses variation of the display gradation due to a fluctuation of the characteristic of the pixel 35.

The signal line driver 33 controls signals inputted into the plurality of scanning lines 31. The signal line driver 34 controls signals inputted into the plurality of signal lines 32.

Here, a process from the time when a digital signal input (control signal CLK (Hsync, Vsync, data enable (DE))+digital video signal (R, G, B)) are inputted into the image processing section 11 to the time when a picture is displayed in the liquid crystal display section 12 is explained. The image processing section 11 performs arithmetic operation of the inputted digital signal and control over the inputted control signal, and outputs a digital video signal and a control signal to the liquid crystal display section 12.

The digital video signal and the control signal outputted from the image processing section 11 to the liquid crystal display section 12 are distributed to the scanning line driver 33 and the signal line driver 34, respectively. The signal line driver 34 converts the digital video signal into an analog voltage signal (D/A conversion) based on both the applied voltage-luminance characteristic with which the pixel 35 is provided, and a conversion characteristic obtained from the gamma characteristic of the inputted video signal.

The signal line driver 34 applies via TFT 37 the signal which is converted into the analog voltage, to the pixel 35 connected to the scanning line 31 to which the scanning line driver 33 selectively applies an ON-state voltage based on the digital video signal and the control signal which are inputted from the image processing section 11. The voltage which the signal line driver 34 applies to the pixel 35 is converted into light by the pixel 35, so as to be displayed as an image.

Figure 3:
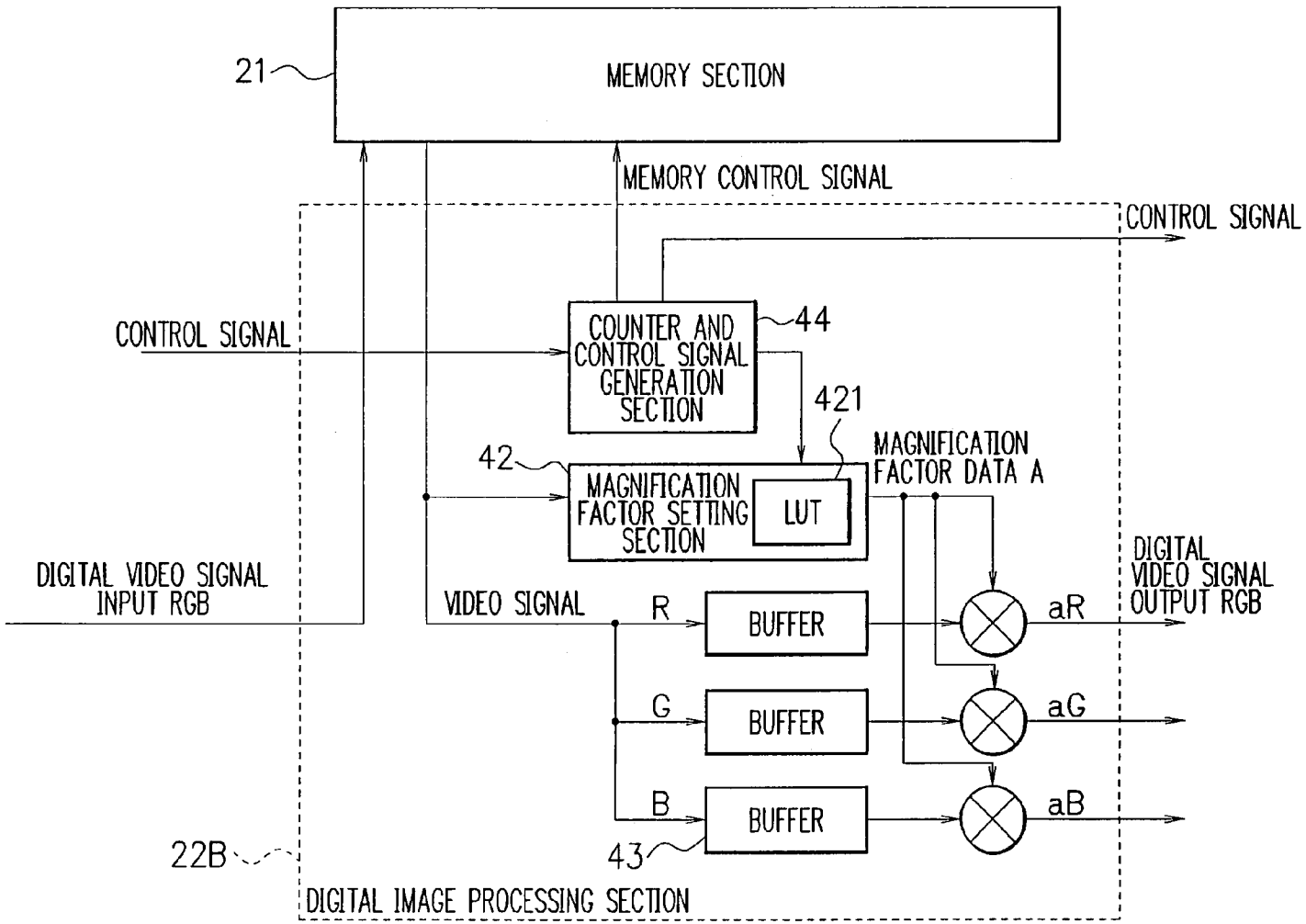
FIG. 3 shows a configuration of an image processing section of the liquid crystal display device according to the first embodiment.

FIG. 3 shows a detailed configuration of the image processing section 11. The digital image processing section 22 comprises: a counter and control signal generation section 44 for controlling the timing of an output control signal based on an inputted control signal and for generating a counter value; the magnification factor setting section 42 for setting a magnification factor based on an inputted video signal and the counter value; a buffer 43 for delaying the video signal by the processing time in the magnification factor setting section 42; and an arithmetic section 41 for performing arithmetic operation on the video signal with the magnification factor set by the magnification factor setting section 42. The digital video signal inputted into the digital image processing section 22 is inputted and outputted to and from the memory section 21 via a FIFO (not shown). The writing and reading of a video signal to and from the memory section 21 is performed in accordance with a memory control signal.

(Operation of the Invention)

Next, an operation of the liquid crystal display device according to the present embodiment is described.

Figure 4:
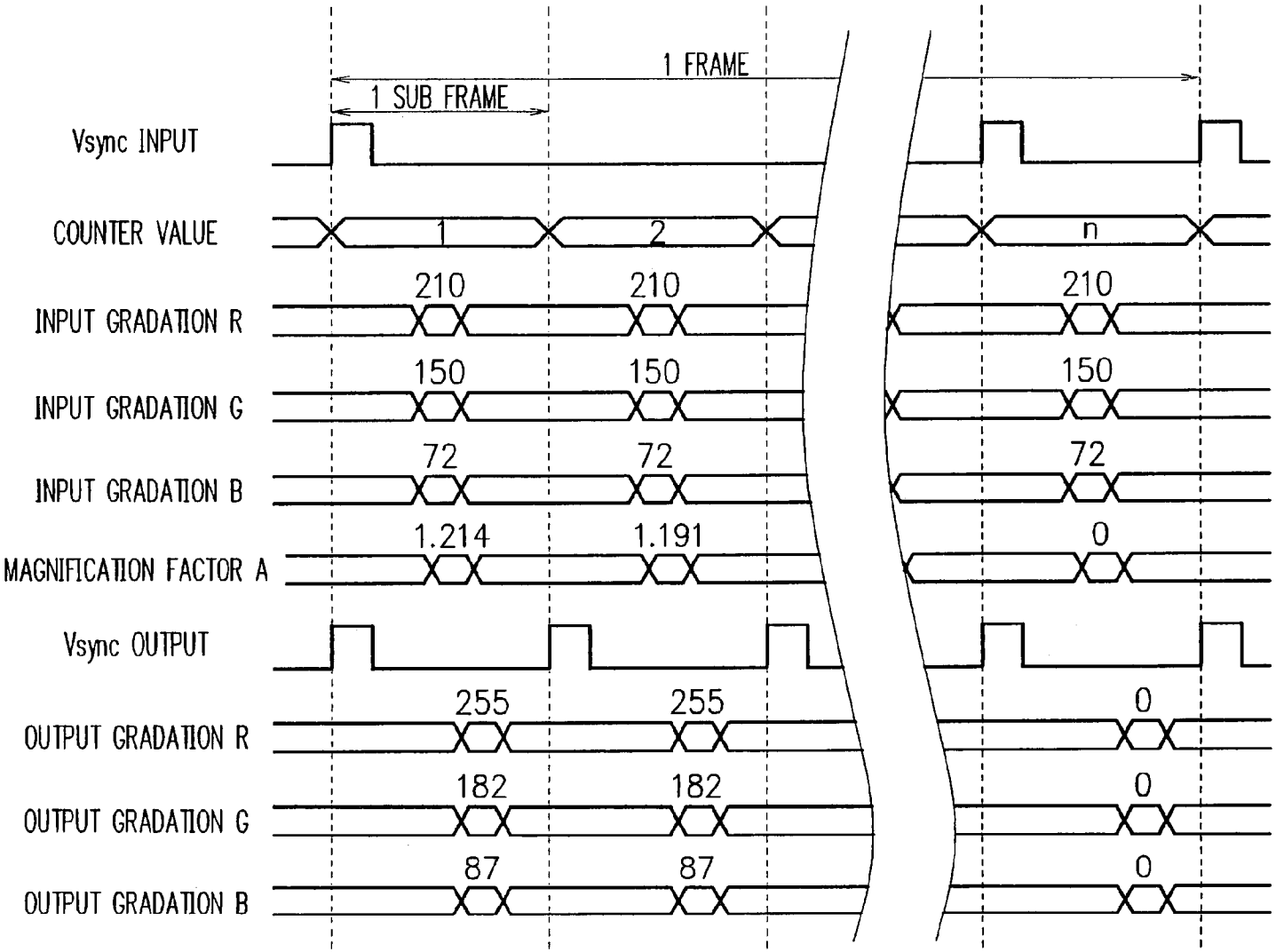
FIG. 4 is a timing chart of a processing operation in a digital image processing section of the liquid crystal display device according to the first embodiment.

FIG. 4 shows a timing chart of each signal inputted and outputted to and from the digital image processing section 22. In the case where one frame is divided into n sub frames, n pulses of the vertical synchronizing signal Vsync is outputted from the counter and control signal generation section 44 within one frame period. The counter value is a value indicating the order number of a sub frame included in one frame, and is changed by the counter and control signal generation section 44 at a rise point of Vsync. The output timing of output signals from the memory section 21 and synchronizing signals, such as Hsync and DE, is also changed to n times the frame frequency by dividing one frame into n sub frames. The timing of these control signals is set by the counter and control signal generation section 44, as in Vsync.

Among the control signals inputted into the counter and control signal generation section 44 in FIG. 3, the vertical synchronizing signal Vsync is sent to the liquid crystal display section 12 as a part of the output control signal, after the frequency thereof is modulated to become n times in the counter and control signal generation section 44. The other control signals are sent to the liquid crystal display section 12 as a part of the output control signal after subjected to the frequency conversion in the counter and control signal generation section 44, as in the vertical synchronizing signal Vsync.

In the counter and control signal generation section 44, a memory control signal is also generated so as to control the writing and reading of image data to and from the memory section 21 corresponding to the generation timing of the synchronizing signal.

A n-notation counter for counting the output of vertical synchronizing signal is provided in the counter and control signal generation section 44. The count value of the counter is a value indicating the order number of the sub frame in one frame, and is sent to the magnification factor setting section 42.

The digital video signal outputted from the memory section 21 is sent to the magnification factor setting section 42 and the buffer 43. In the buffer 43, for synchronizing with the processing result of the magnification factor setting section 42, the output is delayed by a predetermined time (time required for calculating the magnification factor a).

In the magnification factor setting section 42, the magnification factor a obtained based on RGB values of the input signal and the counter value is outputted. In order to distribute each color component similarly, the magnification factor a needs to be the same value for any color component of RGB. For this reason, the magnification factor setting section 42 extracts a color component with the maximum luminance value from each color component of RGB and determines the magnification factor with reference to a look-up table (LUT) 421 based on the luminance value and the count value of the color component.

FIG. 5 shows a configuration of the LUT 421 stored by the magnification factor setting section 42 in the present embodiment. Here, the input signal value is assumed to be subjected to the gamma correction of $\gamma=2.2$. The maximum gradation value corresponding to white display is also assumed to be 255 gradation (8 bits). Since one frame is time-divided into n sub frames, the luminance which can be expressed by one sub frame is expressed in the range of 0 to 1/n, when the maximum luminance in one frame is assumed to be 1.

In the case where the maximum value of each color component of RGB is no more than $\mathrm{int}(255\times(1/n)^{1/2.2})$ gradation, (where int(x) is a function for taking integer part of x), or less than 1/n when converted into luminance, the magnification factor setting section 42 determines the magnification factor a such that all luminance components are distributed to the first sub frame.

In the case where the maximum value of each color component of RGB is no less than $\mathrm{int}(255\times(1/n)^{1/2.2})+1$ gradation, and no more than $\mathrm{int}(255\times(2/n)^{1/2.2})$ gradation (no less than 1/n and less than 2/n, when converted into luminance), the magnification factor setting section 42 determines the magnification factor a such that all luminance components are distributed to the first and second sub frames.

Alternatively, when the maximum value of each color component of RGB is no less than $\mathrm{int}(255\times(n-1/n)^{1/2.2})+1$ gradation, (no less than (n−1)/n, when converted into luminance), the magnification factor setting section 42 determines the magnification factor a such that luminance components are distributed so as to leave in the n-th sub frame the luminance components as least as possible.

The arithmetic section 41 multiplies the magnification factor a, which is determined by the magnification factor setting section 42, by each color component R, G, B of the input video signal, and outputs the result (aR, aG, aB) to the liquid crystal display section 12 as a digital video signal output.

Within one frame period, since the integrated luminance is not changed before and after the arithmetic operation in the arithmetic section 41 (in other words, between the digital video input signal and the digital video output signal), the maximum luminance and the contrast are not reduced, and the pseudo impulse display is also realized, as a result of which the moving picture quality is improved.

Here, the same value is assumed to be used for each color component of RGB, when determining the above described magnification factor a. This is because that in the case where the ratios of luminance components among sub frames are configured to be different, a false color (a color different from the color desired to be displayed) is generated at the time of displaying a moving picture. However, even if the magnification factor of each color component of RGB is not the same, the effect of improving the moving picture quality is obtained.

In this way, by concentrating the luminance components on a part of sub frames without regard to the number of divisions of one frame, n, the moving picture quality is improved, without lowering the luminance. With larger values of n, the display in the luminance value of 0, i.e., the black display, is more easily performed, as a result of which the significant effect of improving the moving picture can be obtained.

An operation of the liquid crystal display device according to the present embodiment is specifically described by taking the case of n=3 as an example.

FIG. 6 shows values of LUT when the input signal values are assumed to be subjected to the gamma correction of $\gamma=2.2$. Here, the maximum gradation value corresponding to white display is assumed to be 255 gradation (8 bits).

In the case where the gradation value of each color component of RGB is at most no more than 154 gradation (less than ⅓ when converted to luminance), the magnification factor setting section 42 determines the magnification factor a such that all luminance components are distributed to the first sub frame.

In the case where the maximum value of the gradation value of each color component of RGB is no less than 155 and no more than 212 gradation (no less than ⅓ and less than ⅔ when concerted into luminance), the magnification factor setting section 42 determines the magnification factor a such that the luminance components of the third sub frame are distributed to both the first and second sub frames.

In the case where the maximum value of the gradation value of each color component of RGB is no less than 213 gradation (no less than ⅔ when concerted into luminance), the magnification factor setting section 42 determines the magnification factor a such that the luminance components of the third sub frame are distributed to the first and the second sub frames so as to leave the luminance components in the third sub frame as least as possible.

The arithmetic section 41 multiplies the magnification factor a, which is determined by the magnification factor setting section 42, by each color component R, G, B of an imput image signal, and outputs the result (aR, aG, aB) to the liquid crystal display section 12 as a digital video signal output.

Within one frame period, since the integrated luminance is not changed before and after the arithmetic operation in the arithmetic section 41 (in other words, between the digital video input signal and the digital video output signal), the maximum luminance and the contrast are not reduced, and the pseudo impulse display is also realized, as a result of which the moving picture quality is improved.

Here, the same value is assumed to be used for each color component of RGB, when the magnification factor setting section 42 determines the above described magnification factor a. This is because that when the ratio of luminance components between sub frames is configured to be different, a false color (a color different from the color desired to be displayed) is generated at the time of displaying a moving picture. However, even when the magnification factor of each color component of RGB is not the same, the effect of improving the moving picture quality may be obtained.

Figure 7:
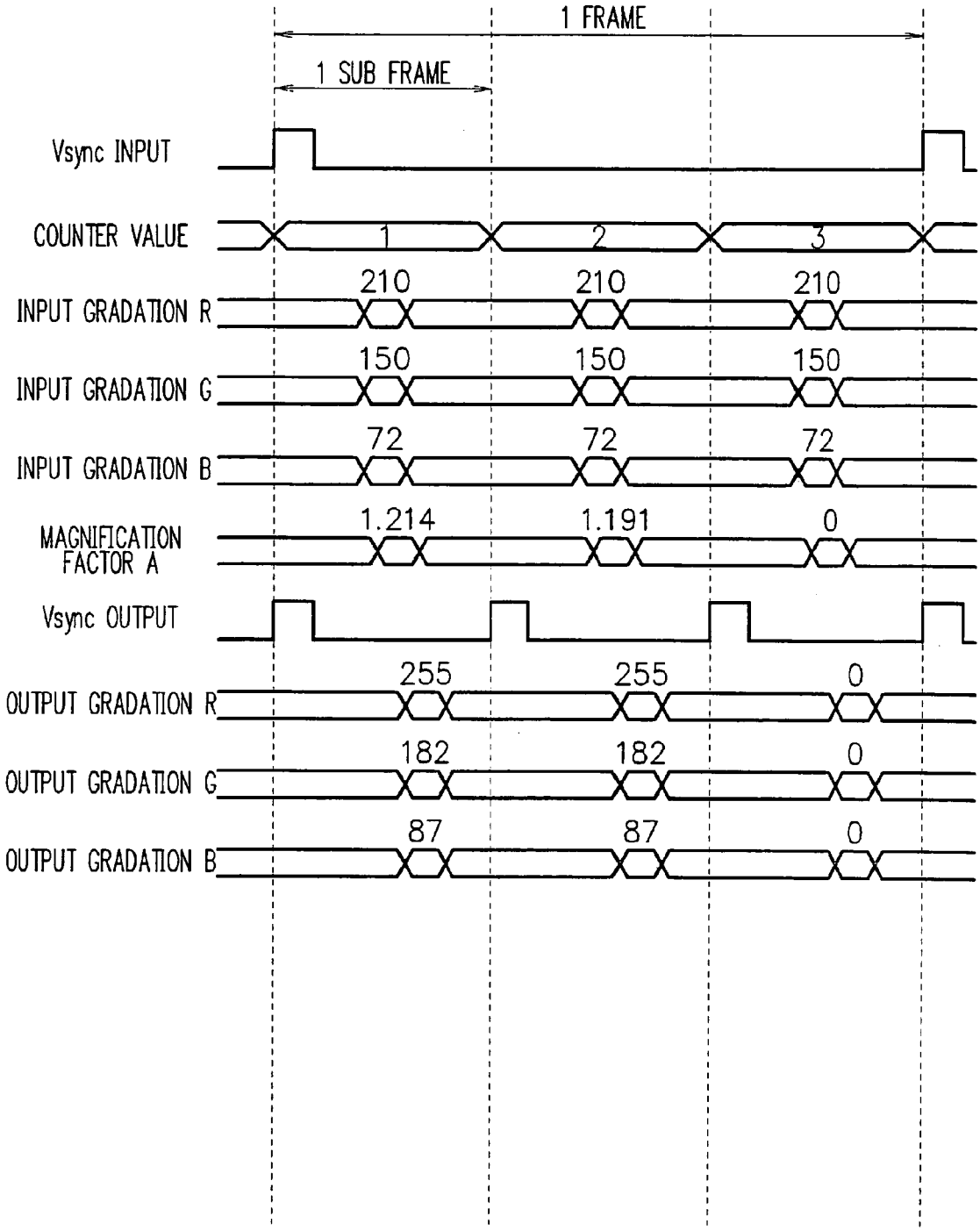
FIG. 7 is a timing chart of a processing operation in the digital image processing section of the liquid crystal display device according to the first embodiment.

The input gradation shown in FIG. 7 is an output signal from the memory section 21, and the output gradation is an output from the arithmetic section 41. The counter value is a signal which is sent to the magnification factor setting section 42 from the counter and control signal generation section 44, and the magnification factor a is a signal which the magnification factor setting section 42 outputs to the arithmetic section 41. The counter value is counted up at a rise point of Vsync output, and shows the order number of the sub frame in one frame.

As shown in the figure, in the case where the RGB gradation signals, in which the gradation value of each color component is set by (R, G, B)=(210, 150, 72), are assumed to be inputted into the memory section 21 for 3 times per one frame, the maximum gradation value of the input signals in this case becomes 210.

The magnification factor a is determined by the magnification factor setting section 42 based on LUT 421 shown in FIG. 6, so that a=1.214 is given for the first sub frame, a=1.191 for the second sub frame and a=0 for the third sub frame.

The input gradation values (digital video signals) used to determine the magnification factor a are also inputted into the buffer 43 from the memory section 21 for each color component of RGB. The delay time of the buffer 43 is set as the time required for the magnification factor setting section 42 to determine the magnification factor a, and the input gradation values delayed by the predetermined time are outputted to the arithmetic section 41.

The arithmetic section 41 performs arithmetic operation for each color component of RGB based on the magnification factor a for each sub frame, and outputs the resultant output gradation values to the liquid crystal display section 12 as a part of the digital video output.

Figure 8:
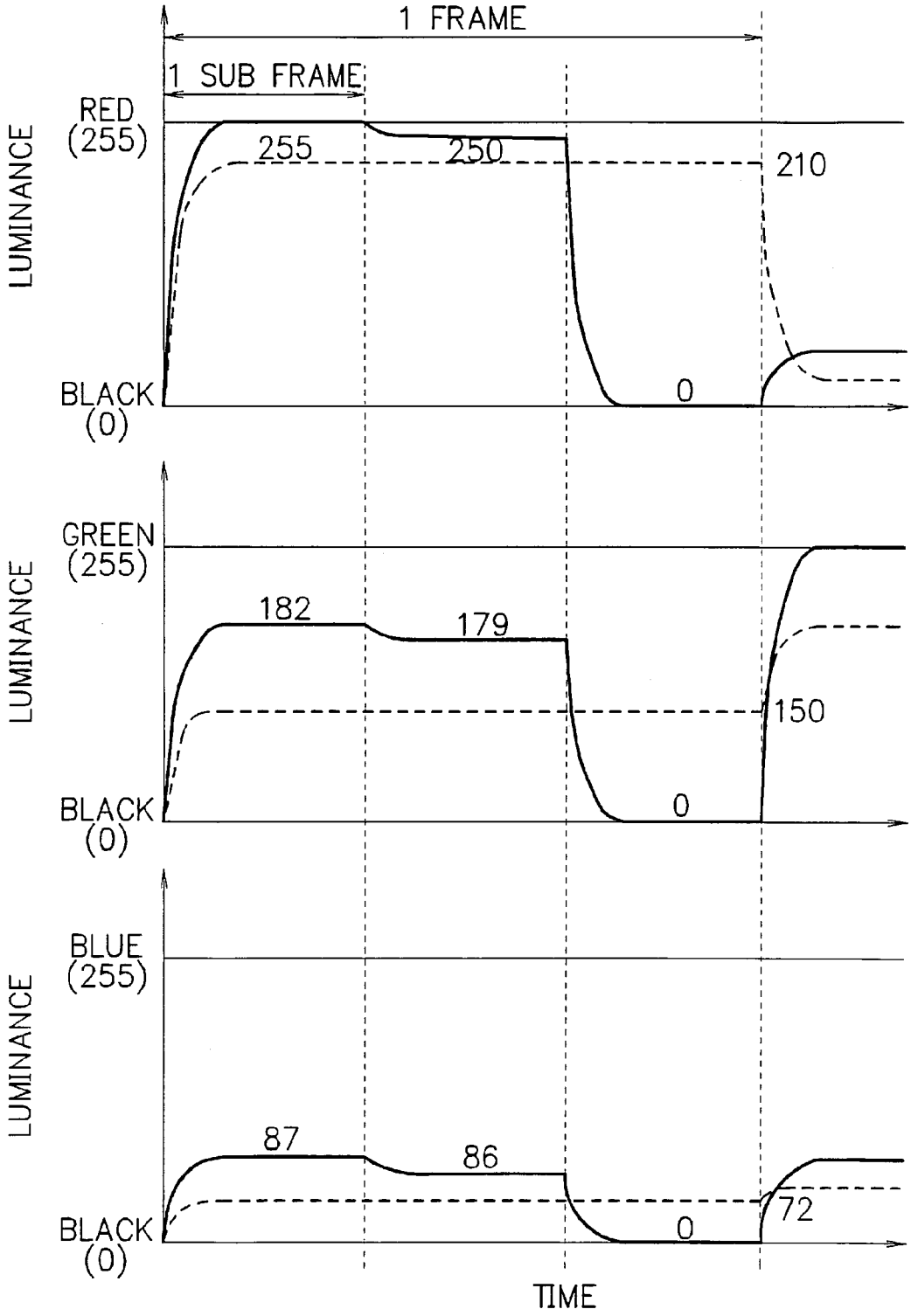
FIG. 8 shows variation of luminance of a pixel in accordance with a signal outputted from the image processing section in the liquid crystal display device according to the first embodiment.

FIG. 8 shows a time-luminance characteristic in the case where voltages in accordance with the outputted gradation values calculated using the above described magnification factor a are applied to the pixel 35 by the scanning line driver 33 and the signal line driver 34.

In the case where the video signal of $\gamma=2.2$ is assumed to be inputted and R luminance components before and after the arithmetic operation in the arithmetic section 41 are compared, it is seen that before the processing, $(210/255)^{2.2}=0.652$, and after the processing, $1/3\times(255/255)^{2.2}+1/3\times(250/255)^{2.2}=0.652$, indicating that the integrated luminance is not changed before and after the processing of the arithmetic section 41. In addition, the third sub frame, of which magnification factor a is 0, is subjected to the black display, thereby enabling the moving picture quality to be improved.

In this way, the liquid crystal display device according to the present embodiment is capable of improving the moving picture quality, without lowering the luminance.

Although examples are described here in which the value of ⅓ and ⅔ are used as a lower limit of the range in the case of the luminance conversion, for determining the magnification factor, the same effect may be obtained even in the case where these values are used as an upper limit of the range.

Second Embodiment

The second embodiment for preferably carrying out the present invention is described. The liquid crystal display device according to the present embodiment comprises an image processing section 11 and a liquid crystal display section 12, as in the liquid crystal display device according to the first embodiment.

Figure 9:
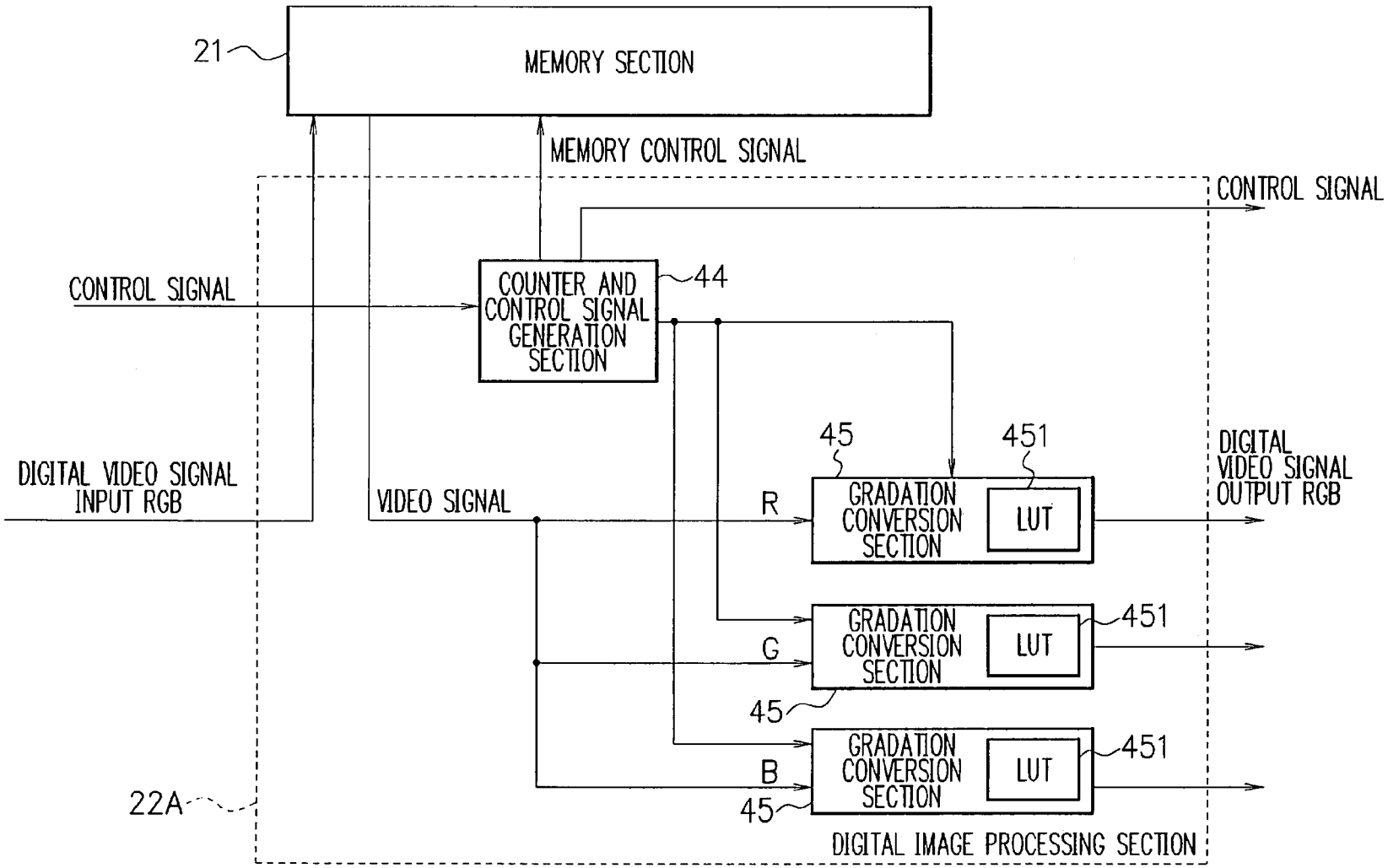
FIG. 9 shows a configuration of an image processing section of a liquid crystal display device according to a second embodiment for preferably carrying out the present invention.

FIG. 9 shows a configuration of the image processing section 11 of the liquid crystal display device according to the present embodiment. In the present embodiment, a digital image processing section 22A does not comprise the arithmetic section 41 and the buffer 43, but instead comprises a gradation conversion section 45.

In the present embodiment, the count value outputted from the counter and control signal generation section 44 and a digital video signal (input gradation value) outputted from the memory section 21 is inputted into the gradation conversion section 45.

In the gradation conversion section 45, a reference is made to an LUT 451 as shown in FIG. 10 based on the inputted gradation values of the digital video signal and the count values, and corresponding values are outputted to the liquid crystal display section 12 as a part of the digital video signal output. The LUT shown in FIG. 10 corresponds to the case of n=3, i.e., when the one frame is time-divided into three sub frames.

In the present embodiment, since a multiplier (arithmetic section 41) is not present in the image processing section 11, the circuit scale of the image processing section 11 can be reduced as compared with the first embodiment.

In the above configuration, the moving picture quality is also improved without lowering the luminance, so that the edge blurring can be reduced.

In the present embodiment, since the LUT is referred to based on the gradation value of each color component, without extracting a color component with the maximum gradation value from each color component of RGB, the effect of preventing the false color can not be obtained as in the case of the liquid crystal display device according to the first embodiment. However, since the false color does not exist in white and black display, in the liquid crystal display device according to the present embodiment, the same moving picture quality as in the liquid crystal display device according to the first embodiment is obtained.

In this way, the liquid crystal display device according to the present embodiment is capable of improving the moving picture quality with a configuration simpler than the liquid crystal display device according to the first embodiment, without lowering the luminance.

Third Embodiment

In the case where the digital video signal input is 8 bits, the above described first and second embodiments are configured such that an LUT, which is referred to at the time of converting the gradation or determining the magnification factor, is provided with records corresponding to 256 gradations (namely, the same number as that of gradations of the digital video signal input).

However, in such configuration, in order to store LUTs 421 and 451 in the magnification factor setting section 42 or the gradation conversion section 45, the memory capacity of 256×(the number of bits required for an LUT for one gradation) is needed. Accordingly, in the present embodiment, a configuration for reducing the memory capacity necessary for storing LUTs is described.

A liquid crystal display device according to the present embodiment comprises an image processing section 11 and a liquid crystal display section 12, as in the first embodiment.

Figure 11:
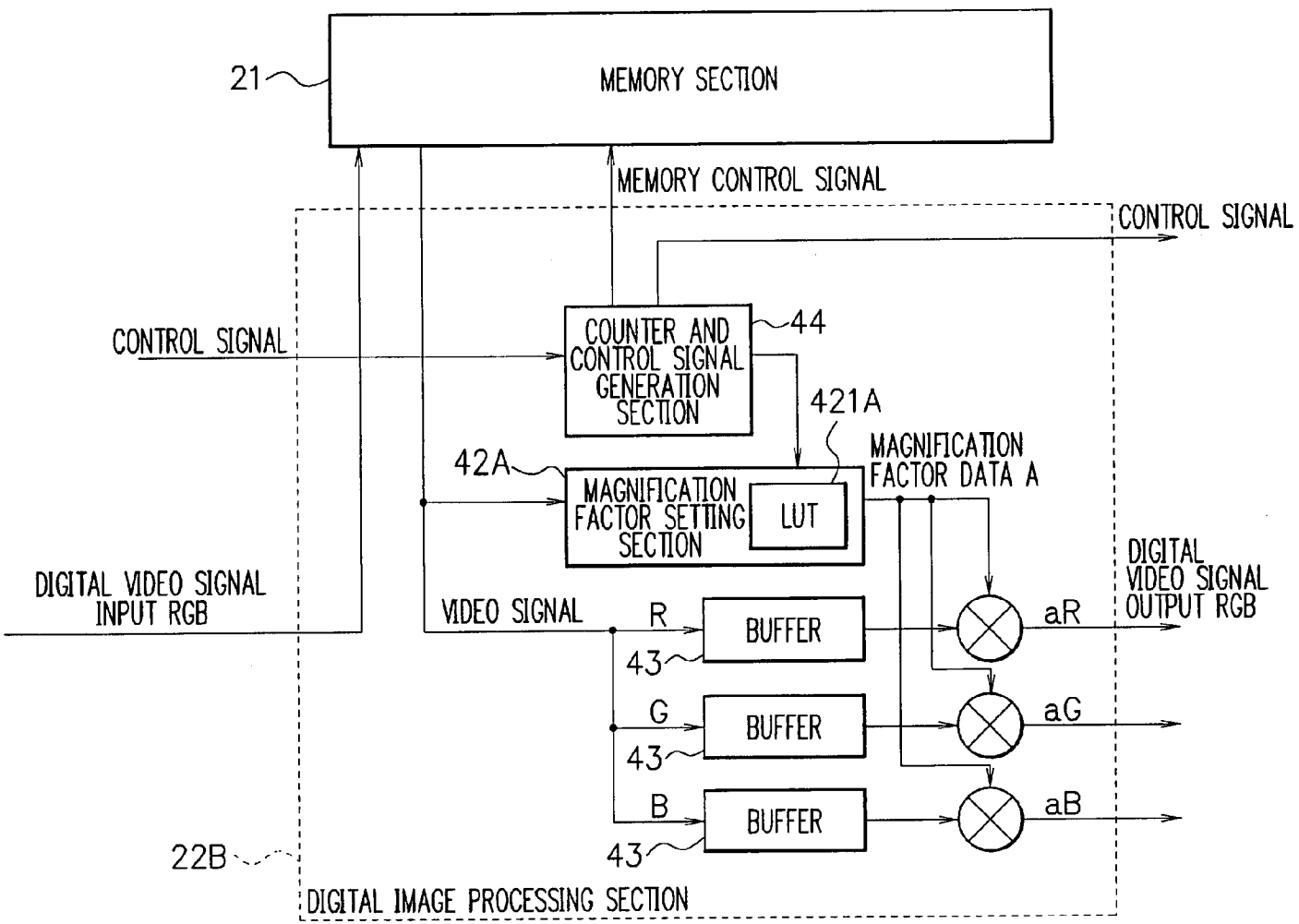
FIG. 11 shows a configuration of an image processing section of a liquid crystal display device according to a third embodiment for preferably carrying out the present invention.

FIG. 11 shows a configuration of the image processing section 11 of the liquid crystal display device according to the present embodiment. In the present embodiment, the image processing section 11 is the same as that of the liquid crystal display device according to the first embodiment, and comprises a memory section 21 and a digital image processing section 22B. However, in the embodiment, an LUT 421A stored by a magnification factor setting section 42A of the digital image processing section 22B is different in the values from an LUT 421 comprised by the magnification factor setting section 42 of the digital image processing section 22 of the liquid crystal display device according to the first embodiment. Although a configuration provided with the same digital image processing section as in the liquid crystal display device according to the first embodiment is described here as an example, such configuration may be a configuration comprising the same digital image processing section as in the liquid crystal display device according to the second embodiment. In this case, an LUT is stored in the gradation conversion section 45.

FIG. 12 shows the LUT 421A stored by the magnification factor setting section 42A in the present embodiment. The LUT corresponds to the case of n=3, i.e., the case of performing processing by time-dividing one frame into three sub frames. In the LUT 421A, the record is configured by three gradation areas which include the area of 0 to 154 gradation in which the maximum gradation is less than ⅓ of white, the area of 155 to 212 gradation in which the maximum gradation is no less than ⅓ and less than ⅔ of white and the area of 213 to 255 gradation in which the maximum gradation is no less than ⅔ of white, and the same value is referred to in each gradation area. These values are the same as the values referred to corresponding to the maximum gradation value in each gradation area in the LUT 421 in the first embodiment shown in FIG. 7, i.e., 154 gradation, 212 gradation and 255 gradation.

Although the amount of data of the LUT 421A which is used by the liquid crystal display device according to the present embodiment, is extremely small as compared with LUTs 421 and 451 of the liquid crystal display device according to the first and the second embodiments, even with the use of the LUT 421A, luminance components can be distributed without the calculation result in the arithmetic section 41 exceeding 255 gradation.

In this way, the liquid crystal display device of the present embodiment is capable of improving the moving picture quality without lowering the luminance, and further capable of reducing the memory capacity, which is required for performing processing for improving the moving picture quality (a memory capacity for storing LUTs), to less than those of the liquid crystal display devices according to the first and the second embodiments.

Fourth Embodiment

A fourth embodiment for preferably carrying out the present invention is described. A liquid crystal display device according to the present embodiment comprises an image processing section 11 and a liquid crystal display section 12 as in the first embodiment.

Figure 13:
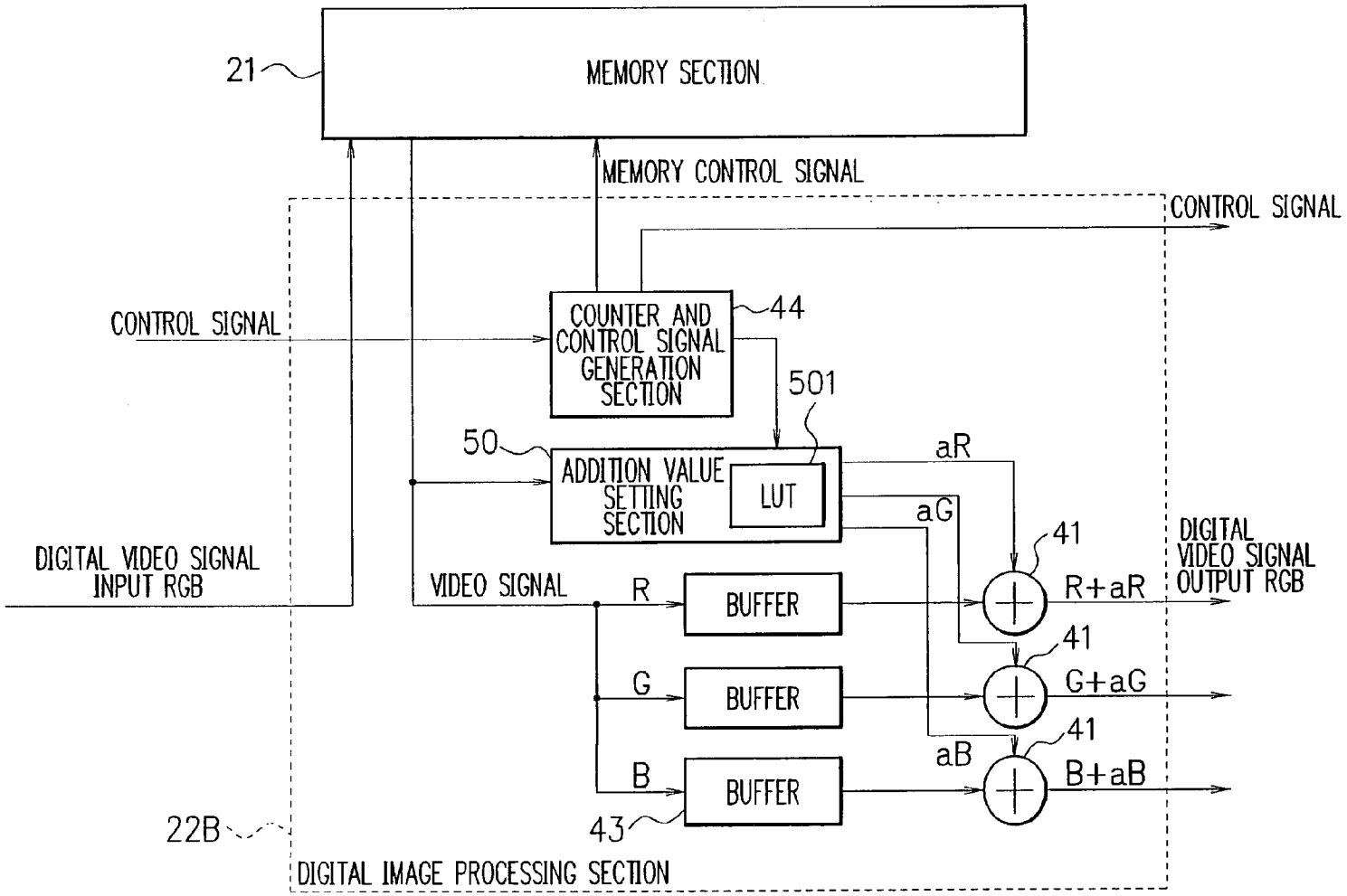
FIG. 13 shows a configuration of a digital image processing section provided for a liquid crystal display device according to a fourth embodiment for preferably carrying out the present invention.

FIG. 13 shows a configuration of the image processing section 11 provided for the liquid crystal display device according to the present embodiment. Although the image processing section 11 provided for the liquid crystal display device according to the present embodiment is almost the same as that of the first embodiment shown in FIG. 3, the configuration of the digital image processing section 22 is different. The digital image processing section 22 in the present embodiment comprises an addition value setting section 50 instead of the magnification factor setting section 42.

The addition value setting section 50 outputs addition values aR, aG, and aB which are different for each color component, based on each color component of R, G, B which are inputted from the memory section 21, and the count value inputted from the counter and control signal generation section 44.

The addition value setting section 50 extracts a color component with the maximum gradation value from each color component of RGB, and determines addition values with reference to an LUT 501 based on the gradation value and the count value of the color component. Thereby, the ratio of the addition value of each color component becomes the same as the ratio of the magnitude of the gradation value of each color inputted from the memory section 21.

Although the arithmetic section 41 performs processing for multiplying the magnification factor a outputted from the magnification factor setting section 42 by the gradation value of each color outputted from the buffer 43, respectively in the first embodiment, in the present embodiment, the arithmetic section 41 performs processing for adding the addition value of each color component outputted from the addition value setting section 50 with the gradation value of each color component outputted from the buffer 43.

Since the other configurations and operations are the same as those of the first embodiment, the duplicating explanation is omitted.

In the present embodiment, within the period of one frame, since the integrated luminance is not changed before and after the arithmetic operation in the arithmetic section 41 (in other words, between the digital video input signal and the digital video output signal), the maximum luminance and the contrast are not lowered, and the pseudo impulse display is realized, as a result of which the moving picture quality is improved.

Fifth Embodiment

In the above described first to forth embodiments, the case where one frame is time-divided into arbitrary n frames (n is an arbitrary natural number), in other words, the case where the drive frequency of the liquid crystal display device is a multiple of a natural number of the video frequency, is described. However, since the present invention is applicable to the case where the drive frequency is not a multiple of a natural number, in a fifth embodiment, the case where the drive frequency is f2 and the image frequency is f1 (f2>f1) is explained.

Figure 14:
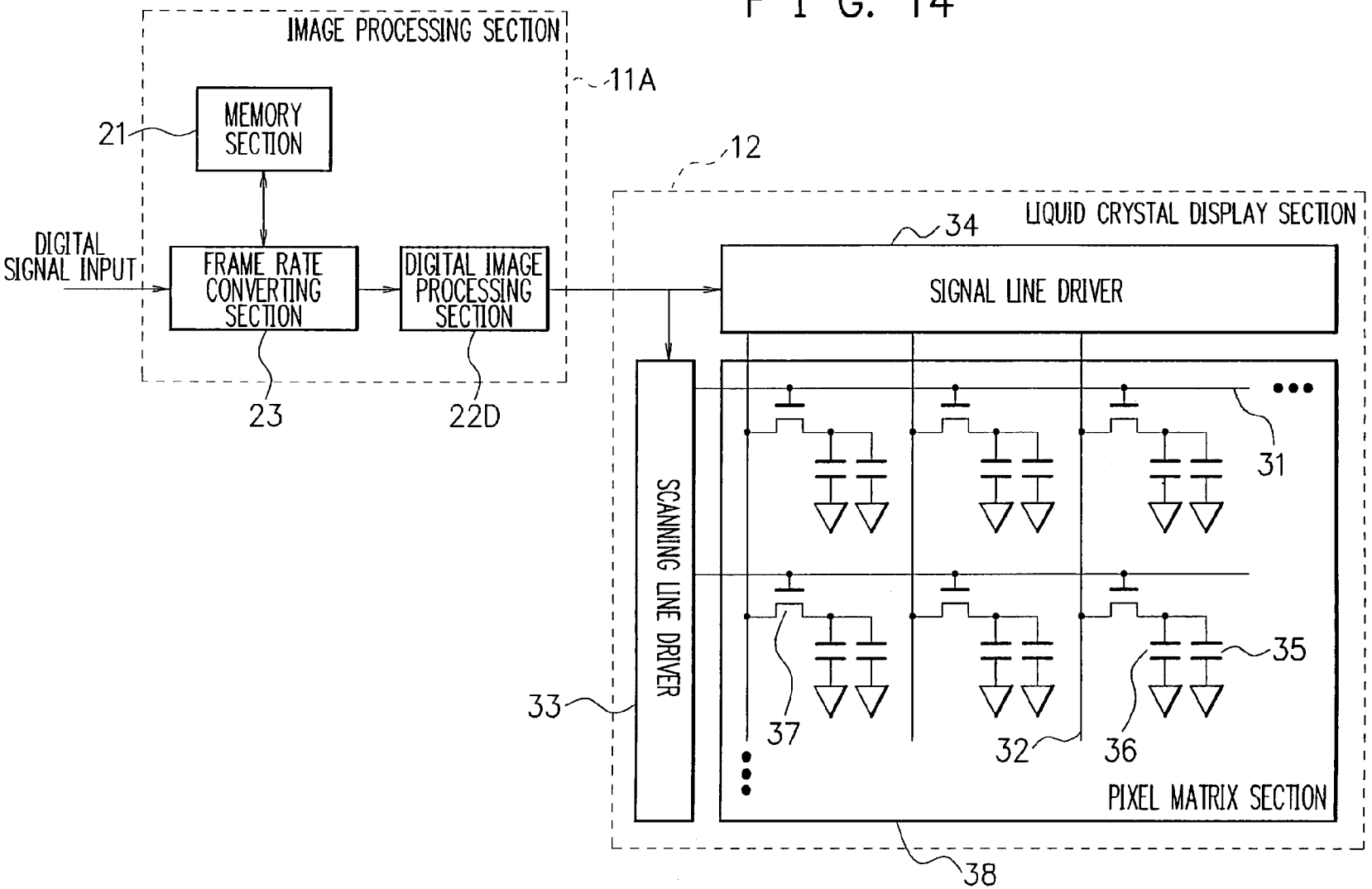
FIG. 14 shows a configuration of a liquid crystal display device according to a fifth embodiment for preferably carrying out the present invention.

FIG. 14 shows a configuration of a liquid crystal display device according to the present embodiment. The liquid crystal display device comprises an image processing section 11A and a liquid crystal display section 12 as in the liquid crystal display device according to the first embodiment. However, in the present embodiment, the image processing section 11A comprises a frame rate converting section 23 in the preceding stage of a digital image processing section 22D.

The frame rate converting section 23 converts the frame frequency of the inputted video signal, and outputs the converted signal to the digital image processing section 22D.

Figure 15:
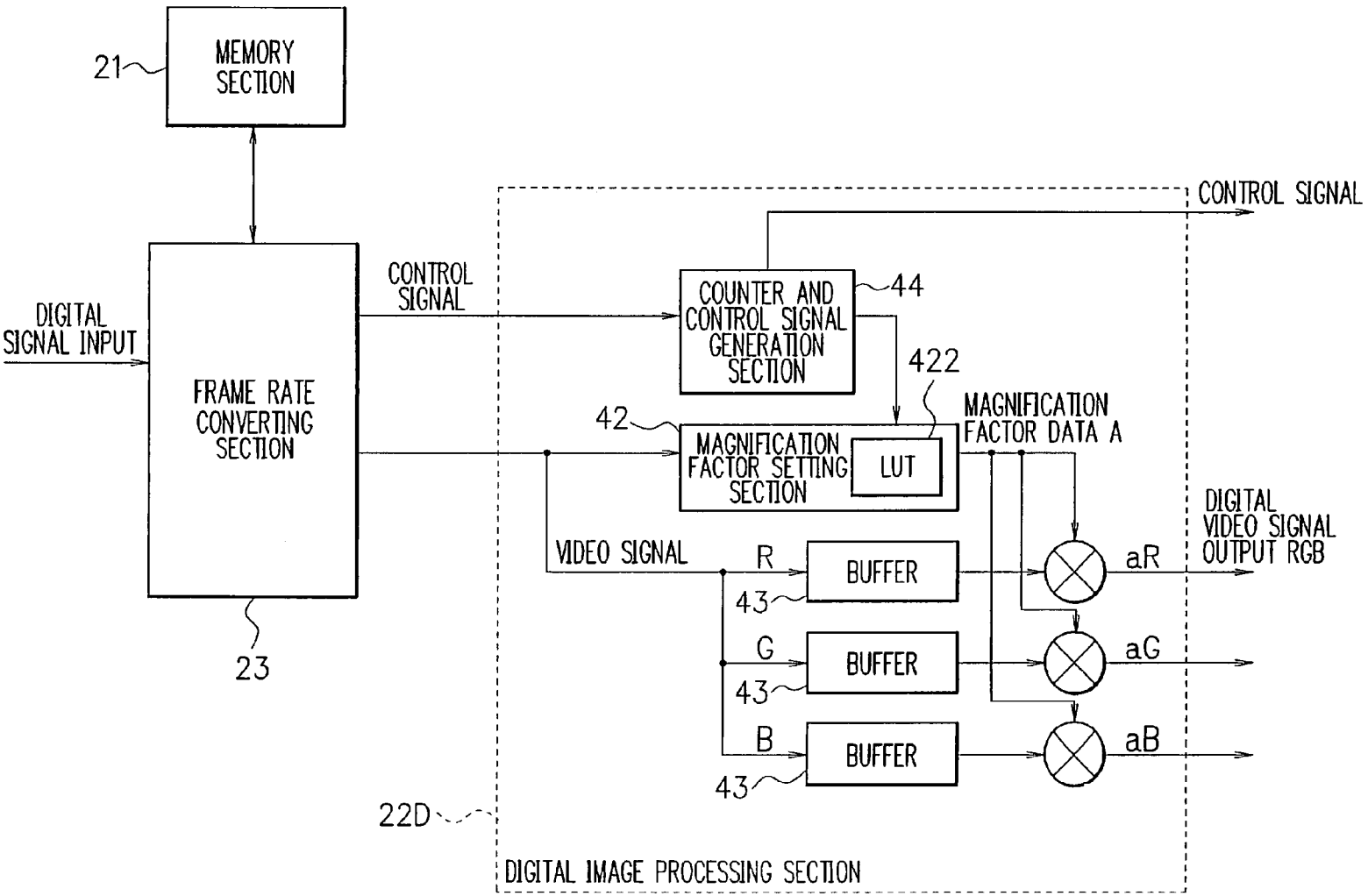
FIG. 15 shows a configuration of an image processing section of the liquid crystal display device according to the fifth embodiment.

Next, a configuration of the digital image processing section 22D is described. FIG. 15 shows a configuration of the image processing section 11A in the embodiment. The digital image processing section 22D comprises an arithmetic section 41, a magnification factor setting section 42, a buffer 43, and a counter and control signal generation section 44 as in the first embodiment. However, in the present embodiment, a control signal and a digital video signal input are not outputted by the memory section 21, but by the frame rate converting section 23, and are inputted into the digital image processing section 22D. In the present embodiment, the writing and reading information into and from the memory section 21 is not controlled by the counter and control signal generation section 44, but by the frame rate converting section 23.

An operation of the frame rate converting section 23 and the digital image processing section 22D is explained with reference to FIGS. 16 and 17.

Figure 16:
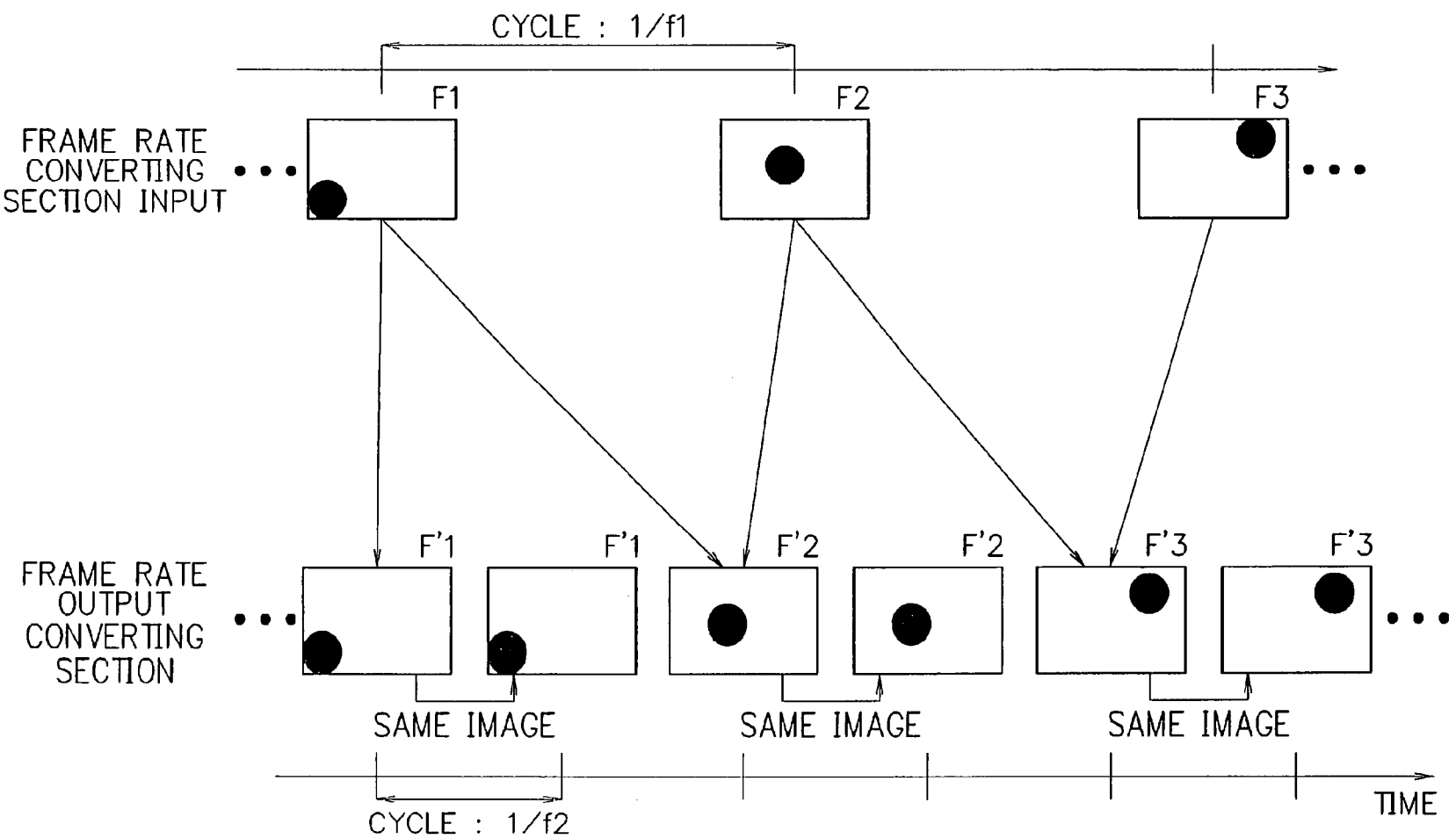
FIG. 16 shows a process in which a frame rate converting section of the liquid crystal display device according to the fifth embodiment generates an output signal.

FIG. 16 is a figure showing a video signal inputted to the frame rate converting section 23 under the condition of f2=2.5×f1, and a video signal outputted from the frame rate converting section 23 to the digital image processing section 22D. The horizontal axis shows time and the frame picture F is temporally changing. The upper stage of the figure shows a time series of frame pictures of the video signal in the input side, and the frame picture changes like F1, F2, F3, - - - . On the other hand, the lower stage of the figure shows a time series of frame pictures of the video signal in the output side, and the frame picture changes like F1', F2', F3', - - - . The input frame picture F1 and the output frame picture F1' are images at the same time.

In a common frame rate conversion, it is necessary to output the frame picture F' for every period of 1/f2 which is the output period. On the other hand, in the liquid crystal display device according to the present embodiment, the frame picture F' is outputted for every period of an integer multiple of the output period, that is, for every period of n/f2.

In the example shown in FIG. 16, the frame picture F' is generated for every 2/f2, and for a frame picture in which the frame picture F' is not generated, an image of one previous frame is outputted as it is. At this time, a time series of frame images outputted from the frame rate converting section 23 becomes F1', F1', F2', F2', F3', F3' - - - , so that the same images are outputted in a plurality of frames. In other words, the image conversion has the same meaning with performing the frame rate conversion of f'2=1.25×f1. However, an image is outputted at a plurality of times within the period of f'2.

Although in the frame rate conversion, the arithmetic operation of conversion processing becomes complicated with the increase of the conversion magnification factor, in the present embodiment, the conversion magnification factor is suppressed to be small, so that the conversion magnification factor in the frame rate conversion can be made small.

Figure 17:
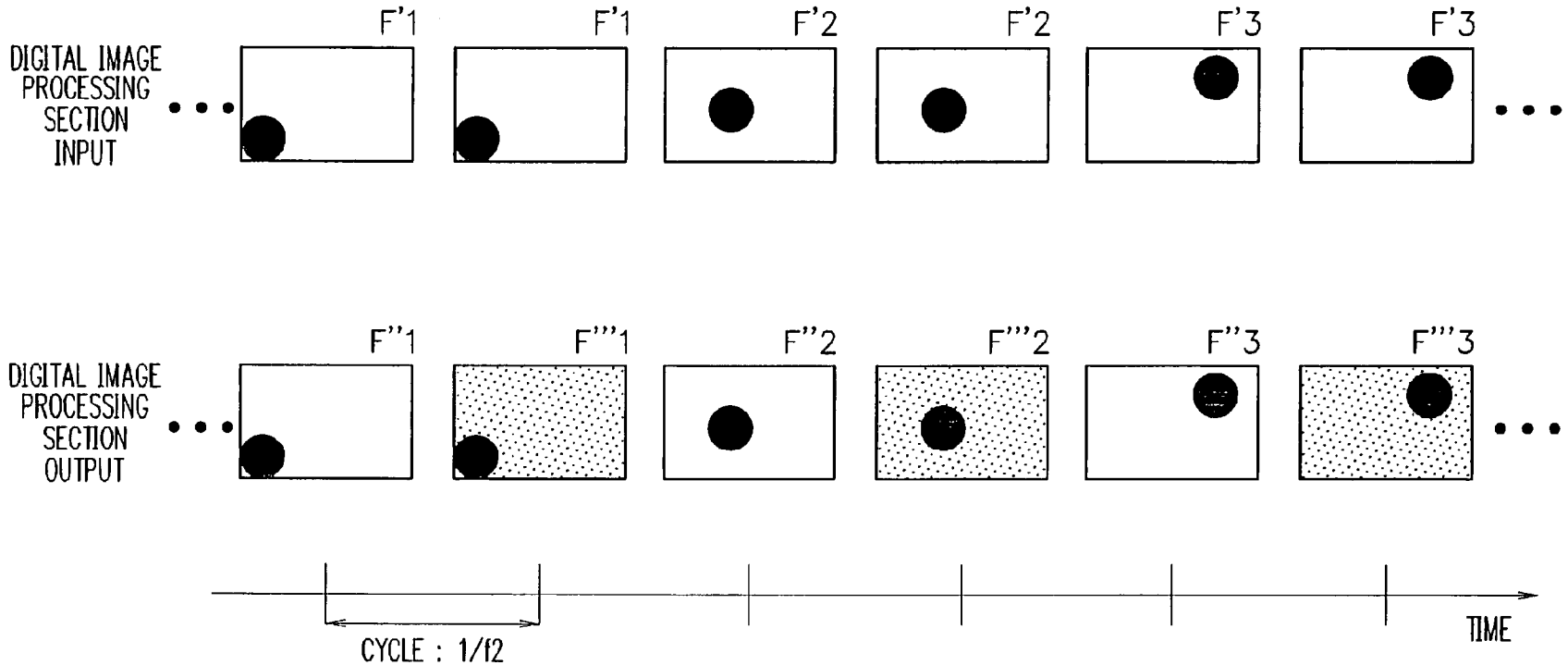
FIG. 17 shows a process in which a digital image processing section of the liquid crystal display device according to the fifth embodiment generates an output signal.

FIG. 17 is a figure showing a video signal inputted to the digital image signal processing section 22D and a video signal outputted from the digital image signal processing section 22D. The horizontal axis shows time and the frame picture F is temporally changing. A time series of frame pictures of the video signal in the input side is shown on the upper stage of the figure, and a time series of frame pictures of the video signal in the output side is shown on the lower stage of the figure.

The processing performed here is the same as the processing described in the first embodiment. That is, in the example shown, since the same images are inputted to the digital image processing section 22D for two consecutive frames, the digital image processing section 22D regards 2/f2 as the first sub frame and 1/f2 as the second sub frame, so as to perform the gradation assignment. As a result, luminous components of the second sub frame are made to be distributed to the first sub frame as much as possible, for obtaining a time series of output frames like F"1, F'"1, F"2, F'"2, F"3, F'"3, - - - .

As described above, in the case where the driving frequency is f2 and the video frequency is f1 (f2>f1), the frequency conversion of f2/nf1 multiple is performed in the frame rate converting section 23, and one frame is regarded as being time-divided into n number of sub frames, so as to be subjected to the gradation assignment in the digital image processing section 22D. Thereby, even in the case where the number of divisions of one frame is an arbitrary positive number, it is possible to improve the moving picture quality without lowering the luminance.

In this way, the effect of the present invention can be obtained, provided that the driving frequency is higher than the video frequency, and one frame can be time-divided into any numbers of sub frames.

Sixth Embodiment

The above described first to fifth embodiments are described in the case where the period of each sub frame constituting one frame is the same. However, the present invention can be applicable to the case where the period of each sub frame constituting one frame is not the same (in other words, the case where one frame is not equally time-divided into sub frames with the same time period), a sixth embodiment is described in the case where the period of each sub frame constituting one frame is different.

A configuration of a liquid crystal display device according to the present embodiment is the same as that of the first embodiment. However, the operation frequency of the counter and control signal generation section 44 is different from that in the first embodiment, and an LUT 423 used by the magnification factor setting section 42 for determining the magnification factor a is also different from the LUT 421 in the first embodiment.

Figure 18:
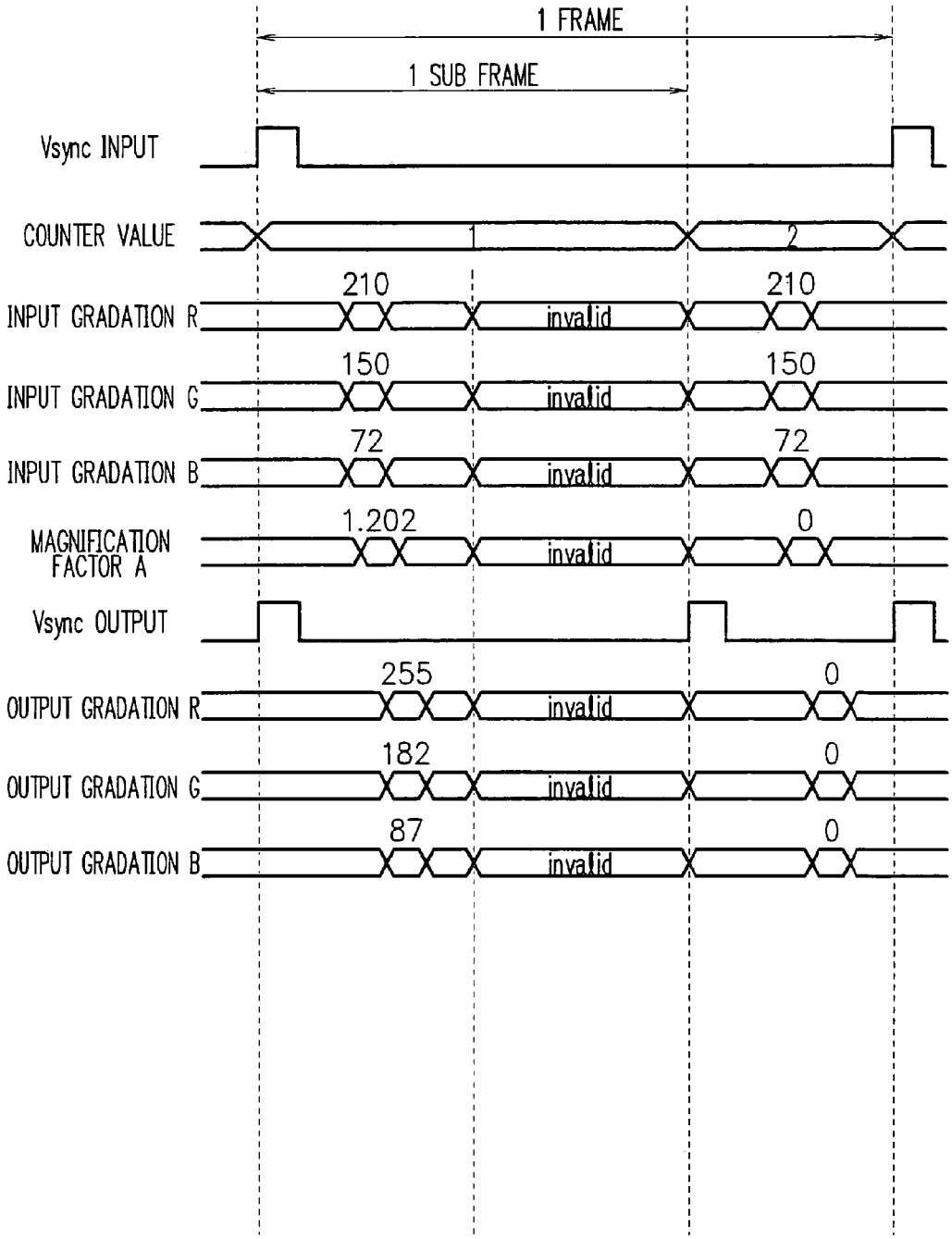
FIG. 18 is a timing chart of a processing operation in a digital image processing section of a liquid crystal display device according to a sixth embodiment for preferably carrying out the present invention.

FIG. 18 shows a timing chart in the case of displaying a picture in the pixel 35 of the liquid crystal display section 12, in the liquid crystal display device according to the present embodiment. Here, it is assumed that one frame is time-divided into two sub frames, and that the ratio of the period of the first sub frame to the period of the second sub frame is 2:1 (the period of first sub frame is twice the period of the second sub frame).

A digital video signal inputted into the image processing section 11 with a video frequency f, after being temporarily stored in the memory section 21, is inputted to the digital image processing section 22 with a driving frequency (i.e. a frequency three times the video frequency) necessary for processing the second sub frame (sub frame with shorter time period).

At this time, a video signal of the same image is inputted into the digital image processing section 22 during the two sub frame periods, as in the above described each embodiment.

Since the length of the time period of the first sub frame is twice that of the second sub frame, the digital video signal in the first sub frame ends in the period of the front half of the first sub frame, so as to be invalid in the rear half of the first sub frame. The digital image processing section 22 does not read out the digital video signal from the memory section 21 during the invalid period.

Vsync is outputted in a pulse mode at the start of each sub frame. At this time, the hold period of the gradation value written in the pixel 35 is made to be twice that of the second sub frame during the period of the first sub frame.

Therefore, when the maximum gradation value of any of the color components of RGB is no more than 212 gradations (less than ⅔ when converted into luminance), all of the luminance components of the second sub frame are distributed to the first sub frame.

When the maximum gradation value of any color component is no less than 213 gradation (no less than ⅔ when converted into luminance), the luminance distribution is performed such that the luminance components are left in the second sub frame as least as possible.

FIG. 19 shows a configuration of an LUT 423 which the magnification factor setting section 42 refers to at the time of distributing luminance components in accordance with such regulation. In the present embodiment, since one frame is divided into two sub frames, an LUT is comprised by the amount of data smaller than the case where one frame is divided into three sub frames.

Figure 20:
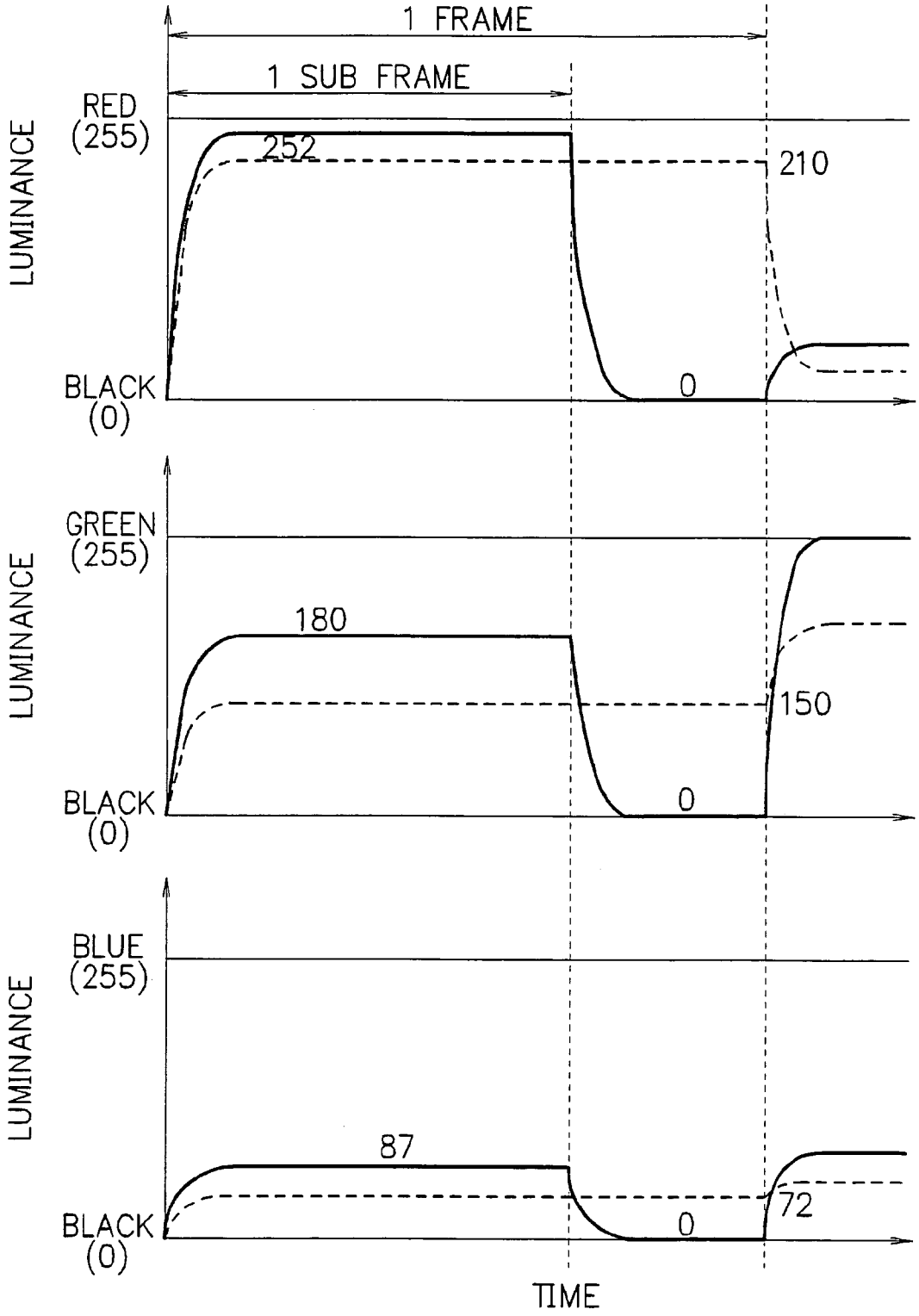
FIG. 20 shows variation of luminance of a pixel in accordance with a signal outputted from the image processing section in the liquid crystal display device according to the sixth embodiment.

FIG. 20 shows the time-luminance characteristic of a video signal which is written in the pixel 35 as a result of performing the data processing described in the present embodiment. Since the luminance components of the second sub frame are distributed to the first sub frame, the black display is performed in the period of the second sub frame, and the pseudo impulse display is realized.

In this way, even in the case where the length of the time period of each sub frame constituting one frame is different from each other, it is possible to improve the moving picture quality, without lowering luminance.

Seventh Embodiment

In each above described embodiment, the liquid crystal display device is described in which the moving picture quality is improved without lowering the luminance, by subjecting a digital video signal to the arithmetic processing and the gradation conversion.

In the present embodiment, a configuration is described which improves the moving picture quality without lowering the luminance, by changing a reference gradation voltage of a D/A converter of a liquid crystal display device.

Figure 21:
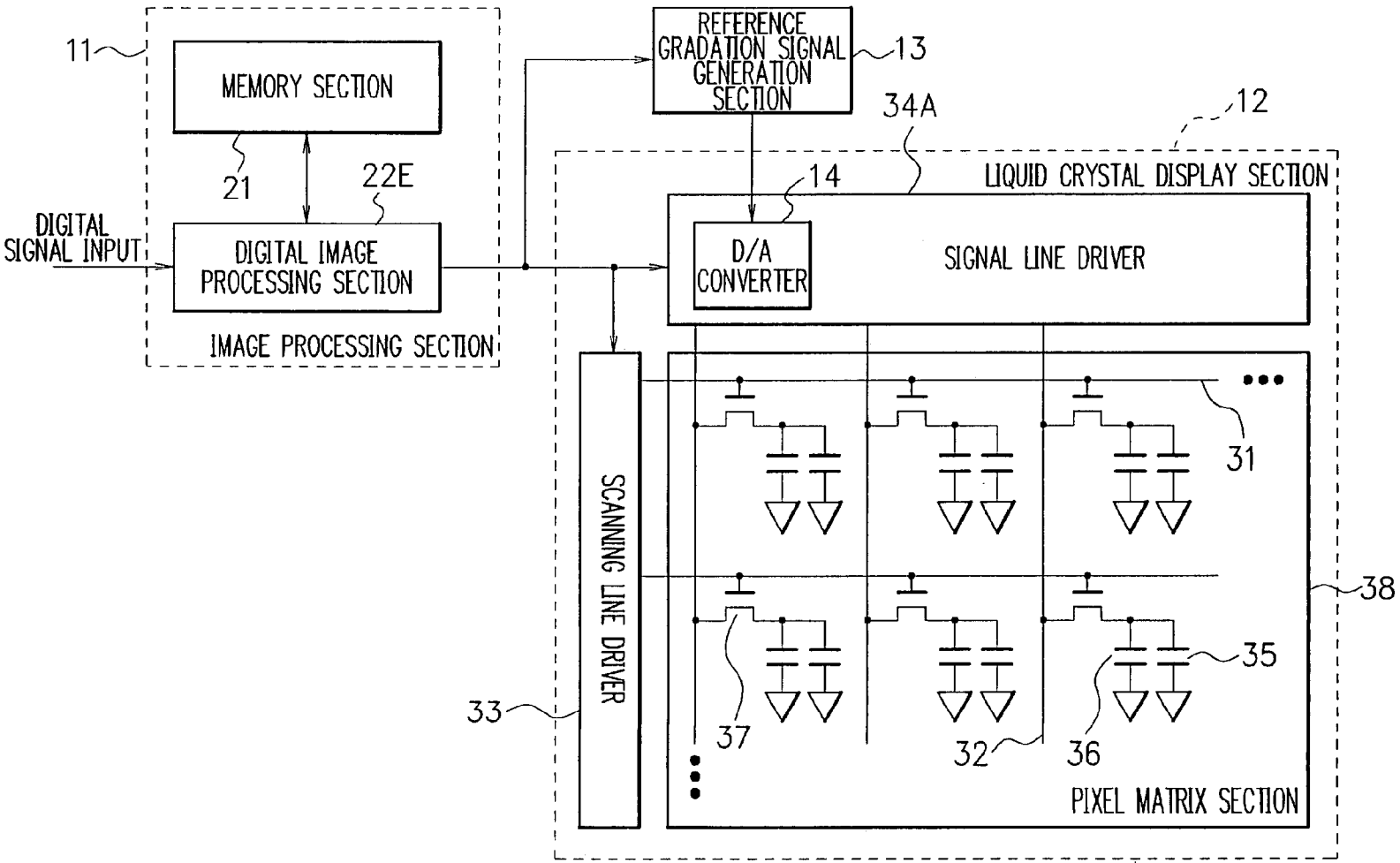
FIG. 21 shows a configuration of a liquid crystal display device according to a seventh embodiment for preferably carrying out the present invention.

FIG. 21 shows a configuration of the liquid crystal display device according to the present embodiment. The liquid crystal display device is the same as the liquid crystal display device according to the first embodiment, except that a reference gradation signal generation section 13 is further comprised.

In the present embodiment, an output from the digital image processing section 22E is sent not only to the liquid crystal display section 12 but to the reference gradation signal generation section 13. An output from the reference gradation signal generation section 13 is sent to a DA converter 14 included in a signal line driver 34A.

Figure 22:
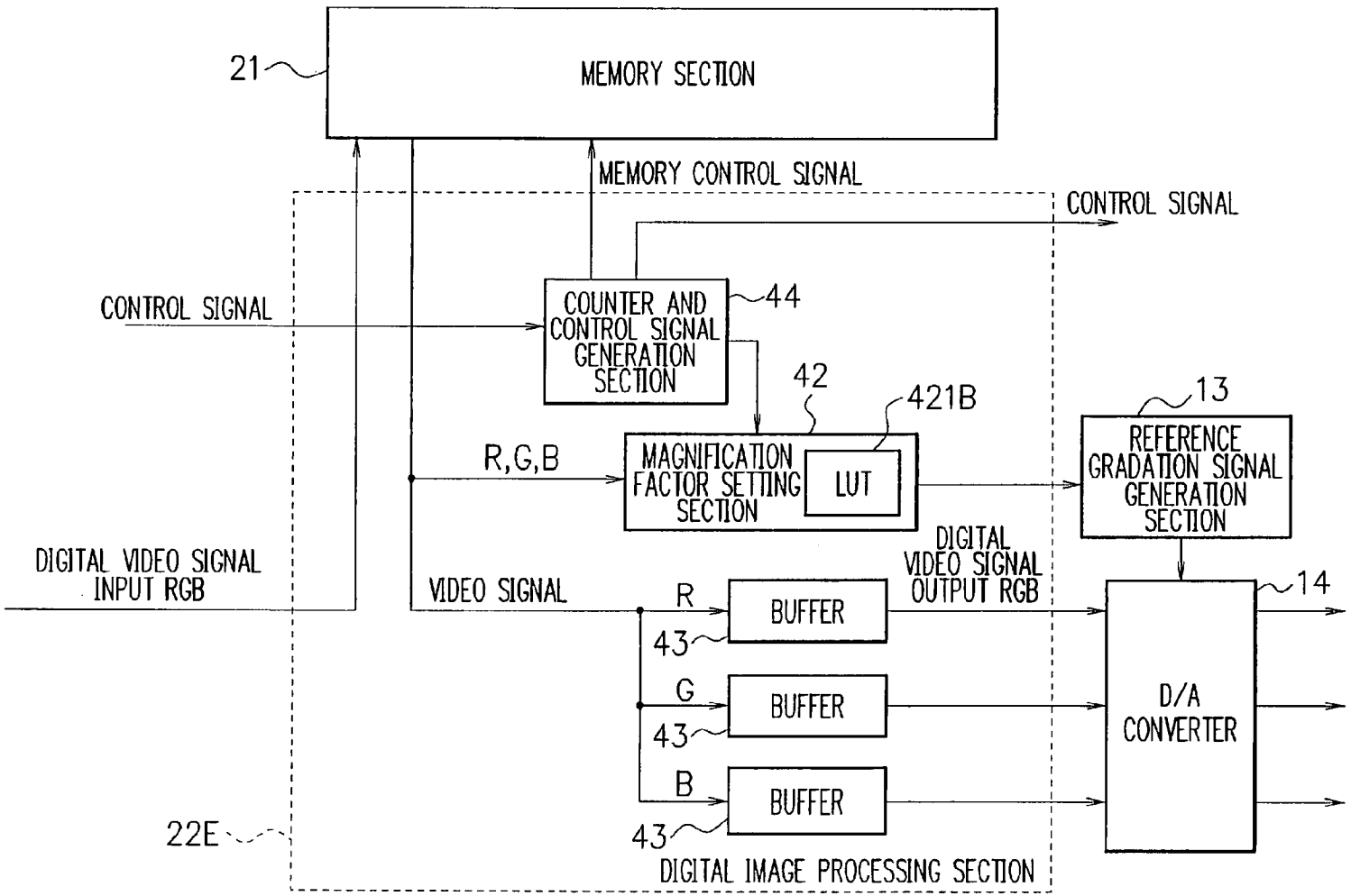
FIG. 22 shows a configuration of an image processing section of the liquid crystal display device according to the seventh embodiment.

FIG. 22 shows a configuration of the digital signal processing section 22E and a condition for connecting the digital signal processing section 22E to the other functional sections. The digital signal processing section 22E is the same as that of the digital signal processing section 22 of the first embodiment, except that the arithmetic section 41 is not comprised. In the present embodiment, magnification factor data outputted from the magnification factor setting section 42B are sent to the reference gradation signal generation section 13. Outputs from the buffers 43 are also sent to the DA converter 14.

In the present embodiment, the processing of the gradation assignment for improving the moving picture quality is performed by the DA converter 14. The reference gradation signal generation section 13 sets a reference gradation voltage based on the magnification factor data inputted from the magnification factor setting section 42B.

Figure 23:
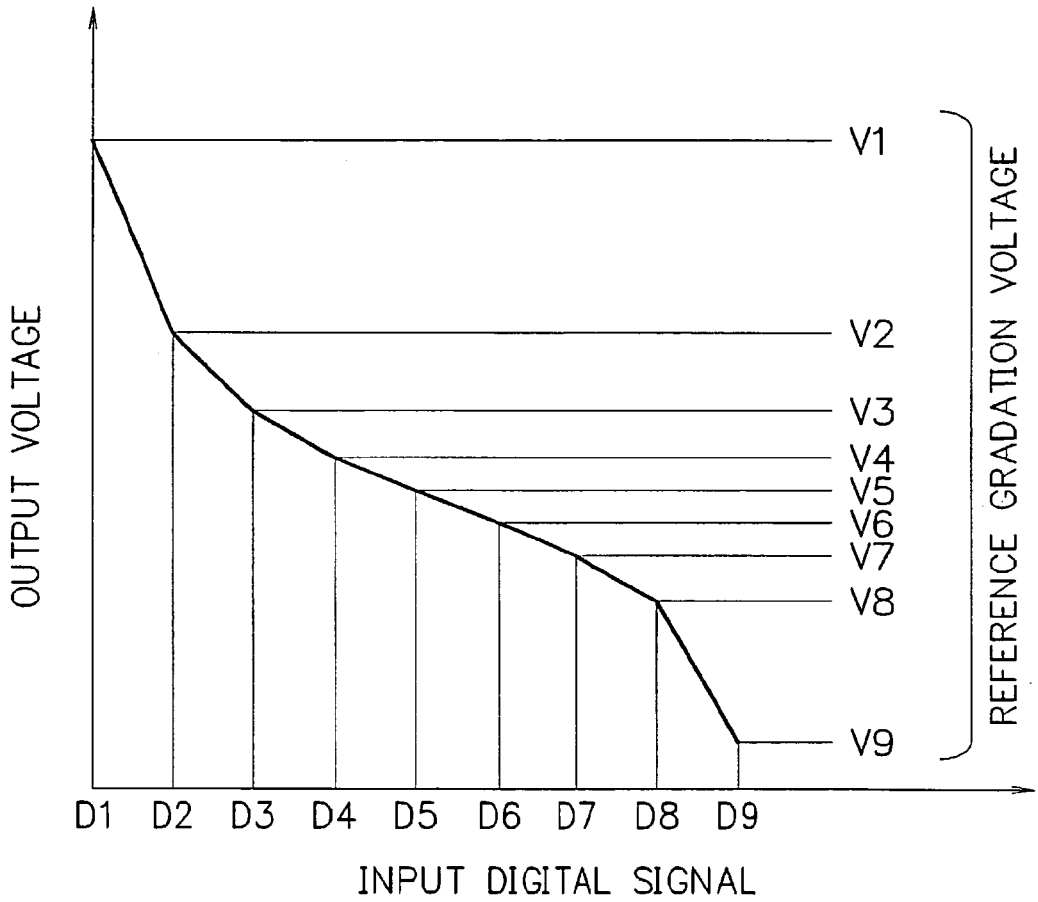
FIG. 23 shows input/output characteristics of a DA converter of the liquid crystal display device according to the seventh embodiment.

The reference gradation voltage includes output voltages V1, V2, - - - , Vn obtained when the gradation values D1, D2, - - - , Dn based on a certain reference are inputted into the DA converter 14. In the DA converter 14, as shown in FIG. 23, an input digital signal is converted into a voltage output based on the reference gradation voltage generated by the reference gradation signal generation section 13. When a gradation value different from the reference gradation value is inputted, the DA converter 14 determines the output voltage by the interpolation method (interpolation).

For example, when a magnification factor data of 1.202 times is outputted from the magnification factor setting section 42B, the reference gradation signal generation section 13 determines the reference gradation voltage such that an output voltage corresponding to the luminance of 1.202 multiple of the output luminance of the input gradation value is outputted.

In DA converter 14, the signal outputted from the buffer 43 is converted into an analog voltage based on the changed reference gradation voltage, and is sent to the pixel 35.

In the present embodiment, since the reference gradation signal generation section 13 changes the reference gradation voltage based on the magnification factor data outputted from the magnification factor setting section 42B, the same gradation voltage as in the case where the arithmetic section 41 performs the gradation assignment as in the first embodiment, is outputted from the DA converter 14.

As a specific example of image processing, the processing which makes the picture amplitude two times (namely, two times in luminance) is described. Although in each embodiment described above, the picture amplitude is changed by performing digital image processing in the digital image processing section 22, in the present embodiment, the reference voltage is generated such that the luminance of the input signal is made two times in the reference gradation signal generation section 13 which receives a signal for "making the luminance two times" from the magnification factor converter 42B, so as to be outputted to the DA converter 14. Thereby, the same output as in the case of performing the processing for making the value of the digital image signal processing value two times is obtained.

Figure 24:
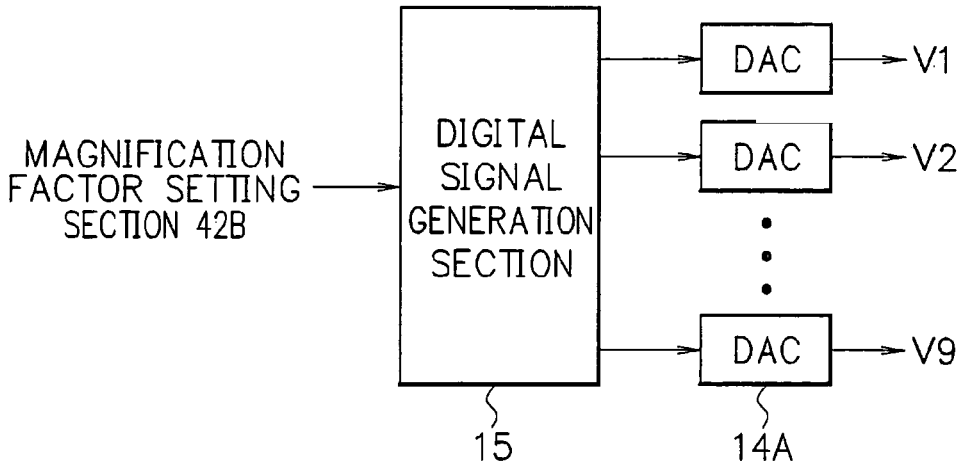
FIG. 24 shows a configuration of a reference gradation voltage generation section.

FIG. 24 shows an exemplary configuration of the reference gradation voltage generation section 13 in the present embodiment. The reference gradation voltage generation section 13 comprises a plurality of DA converters (DAC) 14 and a digital signal generation section 15. The digital signal generation section 15 outputs a digital signal corresponding to the values of reference gradation voltage V1 to V9 to the DA converters 14 based on the signal sent from the magnification factor setting section 42B. The DA converters 14 output analog voltages corresponding to the signal inputted from the buffer 43, based on the signal sent from the digital signal generation section 15.

By performing the above processing, the DA converters 14 is enabled to generate a desired reference gradation voltage for an arbitrary conversion signal outputted by the magnification factor setting section 42B.

Here, the magnification factor setting section 42B is configured to acquire the maximum gradation for each of the pixels 35, and the reference gradation signal generation section 13 changes the reference gradation voltage with the dot clock (clock for sending one pixel data).

Figure 25:
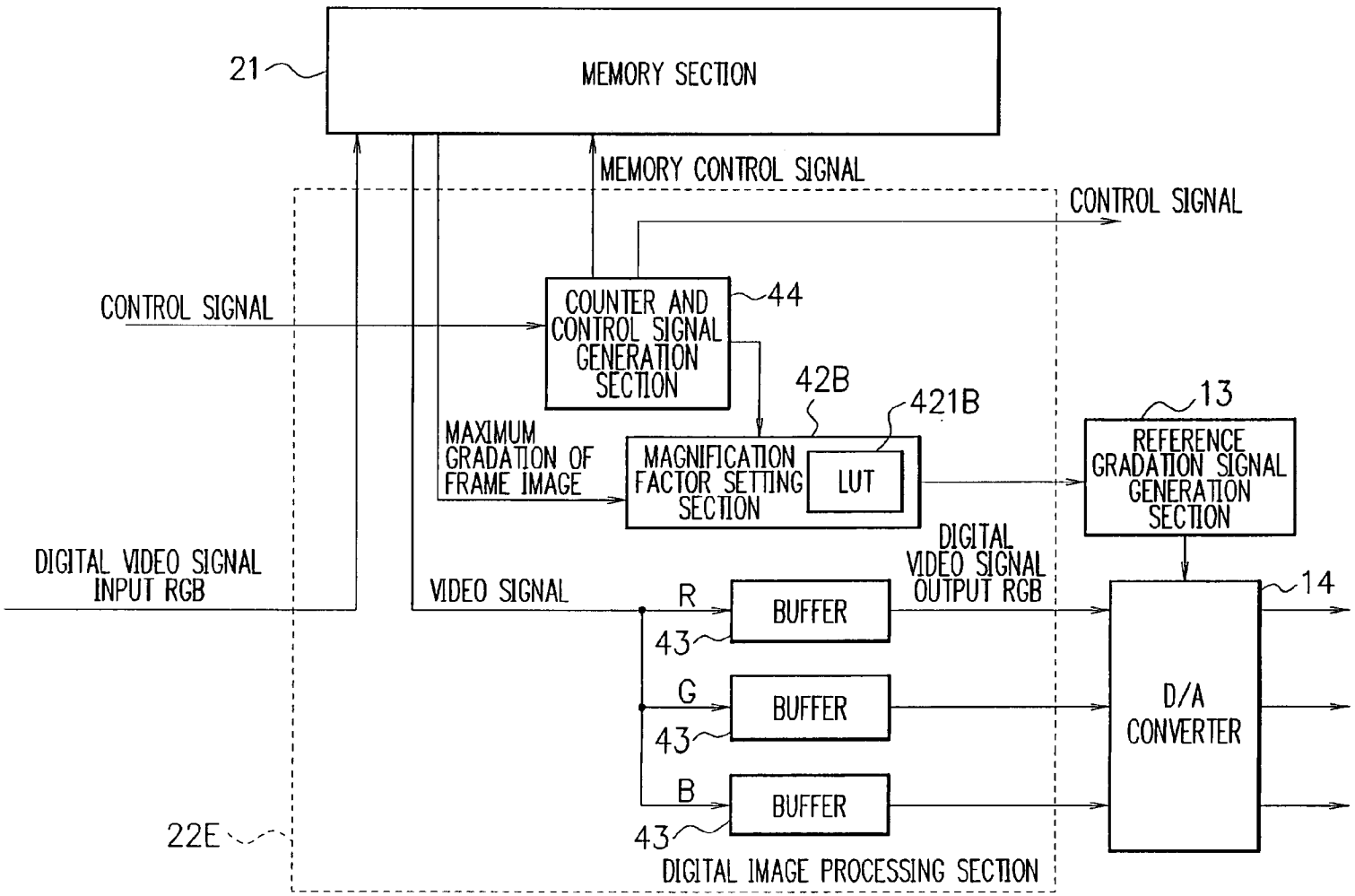
FIG. 25 shows another exemplary configuration of the image processing section of the liquid crystal display device according to the seventh embodiment.

On the other hand, as shown in FIG. 25, by taking the maximum gradation value, which is sent to the magnification factor setting section 42B, as the maximum gradation value of the entire screen display of one frame, it is also possible to allow the reference gradation signal generation section 13 to change the reference gradation voltage once for every frame.

In this way, it is possible to improve the moving picture quality, without lowering the luminance by changing the reference of the voltage applied to the pixel, instead of the digital processing of a video signal.

Eighth Embodiment

In each embodiment described above, the operation is described under the condition that the response period of the pixel applied to the liquid crystal display device is shorter than the period of the sub frame. In the present embodiment, the case where the response period of the pixel is longer than the period of a sub frame is explained.

Figure 26:
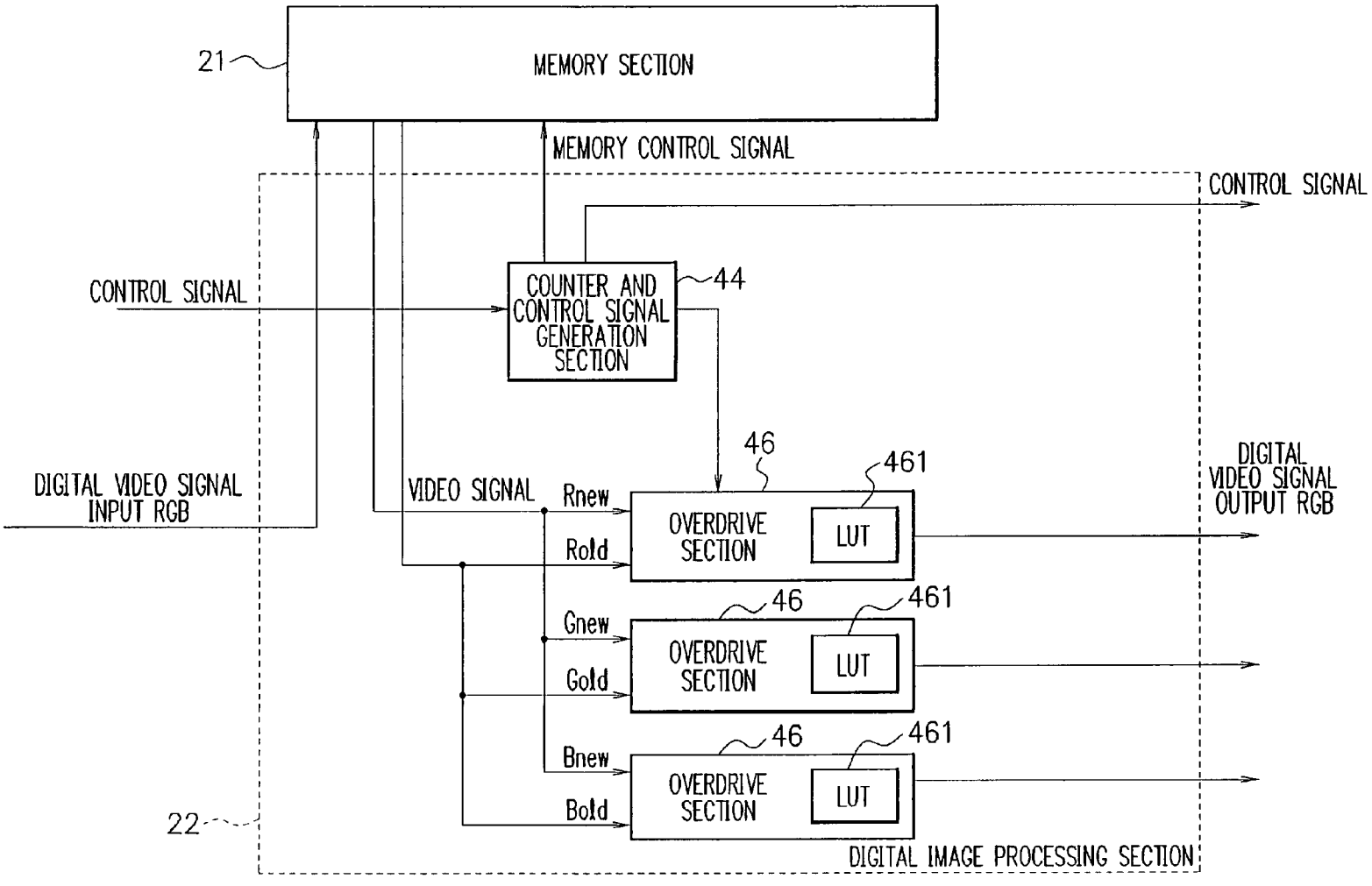
FIG. 26 shows a configuration of an image processing section of a liquid crystal display device according to an eighth embodiment for preferably carrying out the present invention.

FIG. 26 shows a configuration of a liquid crystal display device according to the present embodiment. An image forming device comprises an image processing section 11 and a liquid crystal display section 12 as in the first embodiment. Although in the present embodiment, the image processing section 11 is almost the same as that of the second embodiment, a digital image processing section 22F comprises an overdrive section 46, instead of the gradation conversion section 45. The overdrive section 46 performs processing for determining the output gradation value with reference to LUTs 461, based on the video signal of one sub frame before and the video signal of the present sub frame.

Two kinds of signals of Xold and Xnew (X=R, G, B) are inputted into the overdrive section 46 from the memory section 21. Here, Xnew is the gradation signal of the present sub frame, and Xold is the signal of the sub frame of one sub frame before in the same pixel.

From the counter and control signal generation section 44, the number of the sub frame is sent to the overdrive section 46 as the count value, as in each embodiment described above. In addition to the gradation signal of the present sub frame, the gradation signal of the sub frame of one sub frame before is inputted into the overdrive section 46 from the memory section 21. The overdrive section 46 performs the gradation conversion based on the inputted sub frame number and the inputted gradation signals using LUT 461, as in the second embodiment. Subsequently, the gradation conversion (overdrive processing) is performed such that the gradation value after one sub frame period approaches the gradation value after the present sub frame is subjected to the gradation conversion, based on the gradation value obtained by the gradation conversion and the gradation value before the conversion. Here, overdrive processing performs the gradation conversion such that the luminance component approaches the desired value during one frame period, in consideration of the response time of the liquid crystal.

Figure 27A:
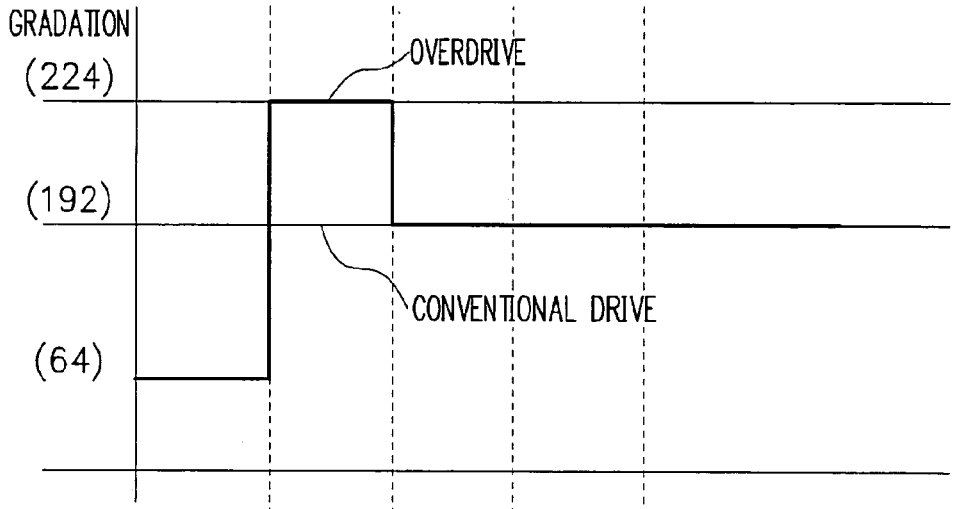
FIG. 27 is a figure for explaining an overdrive processing, in which A shows an input gradation value and B shows a transmissivity.

The overdrive processing specifically means a processing in which in the case where the display gradation of the pixel 35 of the liquid crystal display section 12 changes from 64 gradation to 192 gradation as shown in FIG. 27A, the gradation values are made to change 64→224→192→ - - - , while ordinary gradation values change as 64→192→192→ - - - . That is, the overdrive processing is a method in which when the gradation value is developed into a value larger than the original gradation value in the case of increasing gradation value, a value smaller than the original gradation value is inputted to the pixel.

Figure 27B:
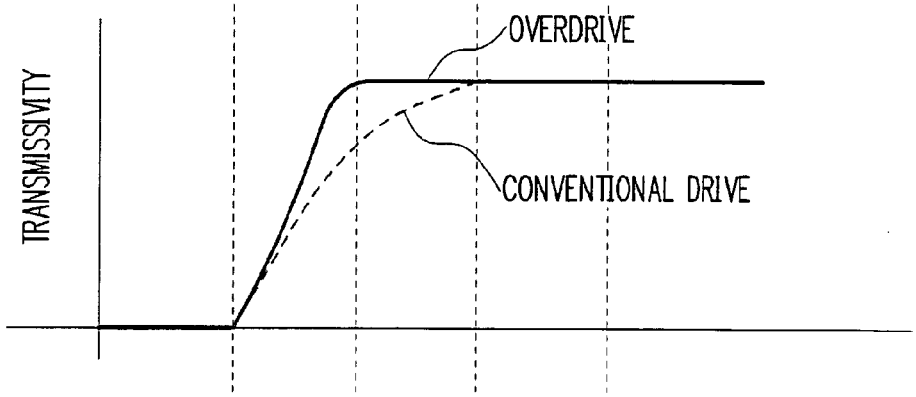

Since a time until reaching a desired intermediate gradation value is shortened by performing the overdrive processing as shown in FIG. 27B, the display is performed as if the response time of the liquid crystal were shortened. However, in the case where the gradation is changed to the maximum gradation and the minimum gradation (in 8-bit display, 0 gradation (black) and 255 gradation (white)), it is not possible to input to the pixel a gradation value larger (or, smaller) than the original gradation value, and hence the overdrive processing cannot be performed.

Here, in designing a liquid crystal display device, it is preferred to change LUTs 461 applied for the gradation conversion, by considering which is faster in the response time from white to black, or from black to white. For example, in the case of normally white TN (twisted nematic) liquid crystal, generally, the response time from white to black is faster than the response time from black to white. At this time, in the response from the third sub frame, which is most likely to be black, to the first sub frame of the subsequent frame, the response to the intermediate gradation has a margin larger than the response to white. Accordingly, in such a case, it is preferred to apply the LUT 461 which assigns the maximum gradation to the second frame, as shown in FIG. 28.

Figure 29A:
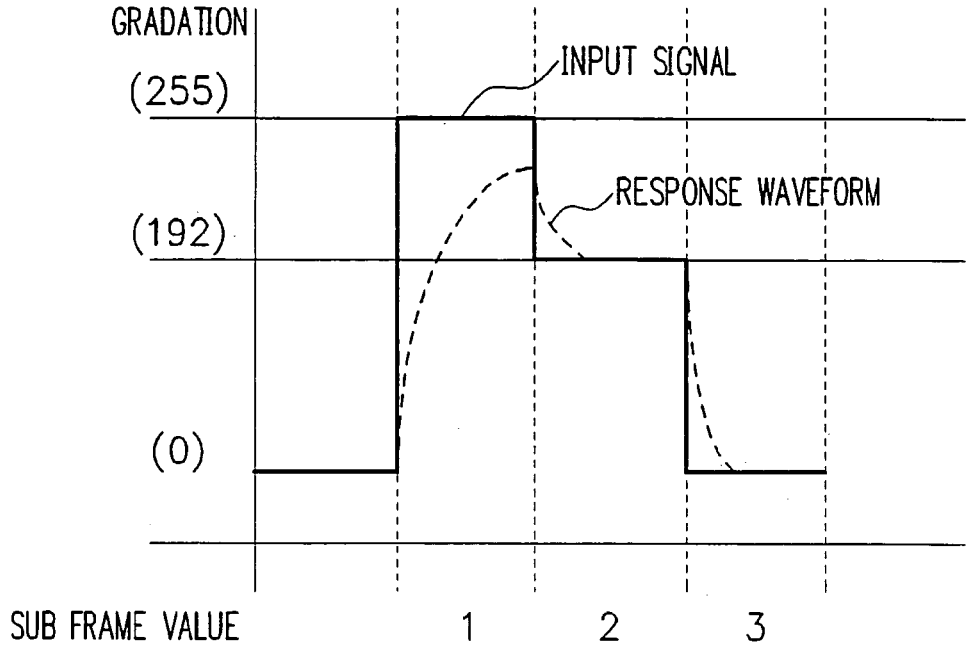
FIG. 29 is a figure for explaining an overdrive processing, in which A shows a response waveform in a conventional driving method, and B shows a response waveform when the overdrive processing is performed.
Figure 29B:
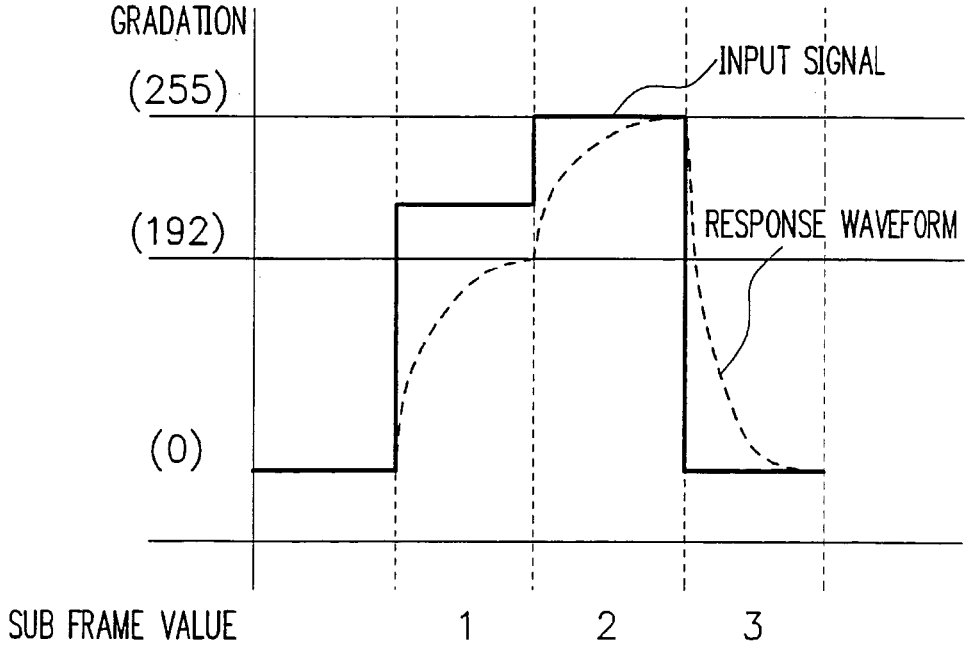

FIG. 29A shows a response waveform in the case where the maximum gradation is assigned to the first sub frame, and FIG. 29B shows a response waveform in the present embodiment employing an LUT as shown in FIG. 28. These waveforms are examples in case where the gradation values of each sub frame are 255, 192, and 0. Here, the response of the liquid crystal is assumed to take a longer time in the case of increasing the gradation value (in the response from 0 to 255 gradation) than in the case of decreasing the gradation value (in the response from 255 to 0 gradation).

As shown in FIG. 29A, when the gradation value of 255 is assigned to the first sub frame, the gradation value of 192 to the second sub frame and the gradation value of 0 to the third sub frame, the liquid crystal is required to respond from the minimum gradation of 0 to the maximum gradation of 255 during the period of the first sub frame. Moreover, since the original gradation value is the maximum gradation in this case, the overdrive processing cannot be performed, either. Therefore, in the case where the response speed of the liquid crystal at the time of increasing the gradation value is low, the response of the liquid crystal is not be completed within the period of the first sub frame, as a result of which the integrated luminance within one frame period comes to be insufficient.

On the other hand, as shown in FIG. 29B, when the gradation value of 192 is assigned to the first sub frame, the gradation value of 255 to the second sub frame and the gradation value of 0 to the third sub frame, the liquid crystal is required to respond to the gradation variation only from 0 to 192 during the period of the first sub frame, and further the response time can be shortened by the overdrive processing. Although the liquid crystal is required to respond to the gradation variation from 192 to 255 during the period of the second sub frame, the range of the gradation variation is smaller than that in the first sub frame, so that the response can be completed during the period of sub frame without performing the overdrive processing.

Here, although the case where the response at the time of increasing the gradation value is slower than the response at the time of decreasing the gradation value is described, in the case where the response at the time of increasing the gradation value is faster, on the contrary, the same effect can be obtained by avoiding to assign a high gradation value to the sub frame just before the sub frame serving as a source for distributing the gradation value.

The application of LUT 461 to the liquid crystal display device in accordance with the response speed of the liquid crystal thus provides a margin in the overdrive processing, so as to prevent luminance from lowering.

In this way, even in the case where the response time of the display element is longer than the period of sub frame, it is possible to improve the moving picture quality without lowering the luminance, by improving the response speed of the display element with the overdrive processing.

Each embodiment described above is an example of preferred implementation of the invention, and the invention is not limited to these embodiments.

For example, although in each embodiment described above, the case where the driving method of the display device (method of writing a signal corresponding to the black output to the pixel) is independently used, is explained, the same effect as in the above described cases can also be obtained even in the case where the method is implemented in combination with a method of flickering the back light and using an electronic shutter, and the like.

In this way, various modification is possible for the present invention.

What is claimed is:

1. An image processing method for a hold type display, comprising:

evaluating a video signal;

dividing the video signal for one frame period into a plurality of sub frames; and distributing at least a part of luminance components of the video signal of a predetermined sub frame to the video signal of other sub frames of which luminance components are not saturated, wherein an integrated luminance in one entire frame period is kept constant, and a drive frequency is set higher than a frame frequency, wherein a response time is shorter than a sub frame period, or the response time is longer than the sub frame period, and overdrive processing is performed when the response time is longer than the sub frame period, and wherein in a case where a first response time at a time of decreasing a gradation value of the hold type display is faster than a second response time at a time of increasing the gradation value, a first luminance component distributed to a first sub frame just before the predetermined sub frame is not lower than a second luminance component distributed to a second sub frame just before the first sub frame, and in a case where the second response time is faster than the first response time, the first luminance component is not higher than the second luminance component.

2. The image processing method according to claim 1, wherein said video signal is a gradation signal indicating an output level of a display element, and wherein gradation values of the video signal of said sub frame are distributed to the video signal of other sub frames.

3. The image processing method according to claim 1, wherein the integrated luminance for one frame period is not changed before and after the distribution of the luminance components.

4. The image processing method according to claim 1, wherein for any video signal of a plurality of color components constituting a color image, at least a part of luminance components of the video signal of a predetermined sub frame is distributed to the video signal of other sub frames of which luminance components are not saturated at the same rate as a color component with the maximum integrated luminance.

5. A display device comprising: image processing means for outputting an inputted video signal as a gradation signal after subjecting the inputted video signal to an image processing; and display means for performing picture display with a luminance in accordance with the gradation signal outputted from said image processing means, wherein said image processing means performs the image processing method according to claim 1, for said inputted video signal.

6. The image processing method according to claim 1, wherein the drive frequency is not a multiple of a natural number of an image video frequency.

7. The image processing method according to claim 1, wherein a number of sub frames as a distribution source for luminance components is the same after processing.

8. The image processing method according to claim 1, wherein all luminance components are distributed to another sub frame without exception so that a gradient value of a sub frame as a distribution source becomes as close to black as possible.

9. A driving method of a hold type display device for displaying light with a luminance corresponding to an inputted video signal in a display element for a predetermined period, comprising:

time dividing the video signal for one frame period into a plurality of sub frames;

distributing at least a part of luminance components of the video signal of a predetermined sub frame to the video signal of other sub frames of which luminance components are not saturated, wherein light with a luminance corresponding to the video signal of each sub frame to which the luminance components are distributed, is displayed by said display element for the period of each sub frame, and an integrated luminance in one entire frame period is kept constant, and a drive frequency is set higher than a frame frequency, wherein a response time is shorter than the sub frame period, or the response time is longer than the sub frame period, and overdrive processing is performed when the response time is longer than the sub frame period, and wherein in a case where a first response time at a time of decreasing a gradation value of the hold type display is faster than a second response time at a time of increasing the gradation value, a first luminance component distributed to a first sub frame just before the predetermined sub frame is not lower than a second luminance component distributed to a second sub frame just before the first sub frame, and in a case where the second response time is faster than the first response time, the first luminance component is not higher than the second luminance component.

10. The driving method of a hold type display device according to claim 9, wherein said video signal is a gradation signal indicating an output level of said display element, and wherein gradation values of the video signal of said predetermined sub frame are distributed to the video signal of the other sub frames.

11. The driving method of a hold type display device according to claim 9, wherein the integrated luminance for one frame period is not changed before and after the distribution of the luminance components.

12. The driving method of a hold type display device according to claim 9, wherein said video signal is a color video signal consisting of a plurality of color components, and wherein for each color component, at least a part of luminance component of the video signal of a predetermined sub frame is distributed to the video signal of other sub frames of which luminance components are not saturated, at the same rate as a color component with the maximum integrated luminance.

13. A display device for performing picture display in accordance with the driving method of a hold type display device according to claim 9.

14. The driving method of a hold type display device according to claim 9, wherein the drive frequency is not a multiple of a natural number of an image video frequency.

15. The image processing method according to claim 9, wherein a number of sub frames as a distribution source for luminance components is the same after processing.

16. The image processing method according to claim 9, wherein all luminance components are distributed to another sub frame without exception so that a gradient value of a sub frame as a distribution source becomes as close to black as possible.

17. A hold-type display device comprising:

image processing means for outputting an inputted video signal as a gradation signal after subjecting the inputted video signal to an image processing; and display means for performing picture display with a luminance in accordance with the gradation signal outputted from said image processing means, said image processing means comprising:

means for time-dividing a video signal for one frame into a plurality of sub frames; and means for specifying an order number of each time divided sub frame, the order number being assigned to each sub frame in one frame; and gradation conversion means for generating gradation signals for said each sub frame, so that at least a part of luminance components of the video signal of a predetermined sub frame is distributed to the video signal of other sub frames of which luminance components are not saturated, and an integrated luminance in one entire frame period is kept constant, and a drive frequency is set higher than a frame frequency, wherein the display device is configured so a response time is shorter than a sub frame period, or the response time is longer than the sub frame period, and overdrive processing is performed when the response time is longer than the sub frame period, and wherein in a case where a first response time at a time of decreasing a gradation value of the hold-type display is faster than a second response time at a time of increasing the gradation value, a first luminance component distributed to a first sub frame just before the predetermined sub frame is not lower than a second luminance component distributed to a second sub frame just before the first sub frame, and in a case where the second response time is faster than the first response time, the first luminance component is not higher than the second luminance component.

18. The display device according to claim 17, wherein said gradation conversion means distributes at least a part of luminance components of the video signal of a predetermined sub frame to the video signal of other sub frames of which luminance components are not saturated, by performing four basic arithmetic operations or by referring to a look-up table.

19. The display device according to claim 17, wherein said video signal is a color video signal consisting of a plurality of color components, and wherein for each color component, at least a part of luminance component of the video signal of a predetermined sub frame is distributed to the video signal of other sub frames of which luminance components are not saturated, at the same rate as a color component with the maximum integrated luminance.

20. The display device according to claim 17, wherein the integrated luminance for one frame period is not changed before and after the distribution of the luminance component.

21. The display device according to claim 17, wherein the drive frequency is not a multiple of a natural number of an image video frequency.

22. The display device according to claim 17, wherein the image processing means further comprises a frame rate converting section adapted to convert the frame frequency.

23. The display device according to claim 17, wherein the display device is configured such that a number of sub frames as a distribution source for luminance components is the same after processing.

24. The display device according to claim 17, wherein the display device is configured such that all luminance components are distributed to another sub frame without exception so that a gradient value of a sub frame as a distribution source becomes as close to black as possible.

25. A hold-type display device comprising:

gradation voltage generation means for generating a gradation voltage signal based on an inputted video signal and for outputting the gradation voltage signal; and display means for performing screen display with a luminance in accordance with said gradation voltage signal;

means for time-dividing the video signal for one frame into a plurality of sub frames;

means for specifying an order number of video signal of each time divided sub frame, the order number being assigned to each sub frame in one frame; and means for changing a reference value so as to enable said gradation voltage generation means to generate said gradation voltage signal, so that at least a part of luminance components of video signal of a predetermined sub frame is distributed to the video signal of other sub frames of which luminance components are not saturated, and an integrated luminance in one entire frame period is kept constant, and a drive frequency is set higher than a frame frequency, wherein the display device is configured so a response time is shorter than a sub frame period, or the response time is longer than the sub frame period, and overdrive processing is performed when the response time is longer than the sub frame period, and wherein in a case where a first response time at a time of decreasing a gradation value of the hold-type display is faster than a second response time at a time of increasing the gradation value, a first luminance component distributed to a first sub frame just before the predetermined sub frame is not lower than a second luminance component distributed to a second sub frame just before the first sub frame, and in a case where the second response time is faster than the first response time, the first luminance component is not higher than the second luminance component.

26. The display device according to claim 25, wherein the drive frequency is not a multiple of a natural number of an image video frequency.

27. The display device according to claim 25, wherein the image processing means further comprises a frame rate converting section adapted to convert the frame frequency.

28. The display device according to claim 25, wherein the display device is configured such that a number of sub frames as a distribution source for luminance components is the same after processing.

29. The display device according to claim 25, wherein the display device is configured such that all luminance components are distributed to another sub frame without exception so that a gradient value of a sub frame as a distribution source becomes as close to black as possible.

* * * * *